US006669818B2

(12) United States Patent
Lindén

(10) Patent No.: US 6,669,818 B2
(45) Date of Patent: Dec. 30, 2003

(54) SHORTENED LAYOUT FROM DRYER TO REEL IN TISSUE MACHINE

(75) Inventor: Anders Tommy Lindén, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/882,659

(22) Filed: Jun. 15, 2001

(65) Prior Publication Data

US 2002/0060036 A1 May 23, 2002

Related U.S. Application Data

(60) Provisional application No. 60/214,507, filed on Jun. 28, 2000.

(51) Int. Cl.[7] ..... D21F 5/02; D21F 7/02

(52) U.S. Cl. ..... 162/283; 162/381; 34/625; 34/659; 242/535.4; 242/548.2; 242/547

(58) Field of Search ..... 162/109–116, 193, 162/199, 202–207, 255, 272, 280–285, 381; 226/93–96, 97.1, 97.3, 97.4; 242/532, 535, 535.4, 547, 548, 548.2, 548.4, 615.11, 615.2, 615.3, 615.4; 34/114–123, 625, 658–659, 444

(56) References Cited

U.S. PATENT DOCUMENTS

| | | | | | |
|---|---|---|---|---|---|
| 1,842,889 | A | * | 1/1932 | Williams | 162/283 |
| 3,732,430 | A | | 5/1973 | Hujer et al. | |
| 4,087,319 | A | * | 5/1978 | Linkletter | 162/113 |
| 4,179,330 | A | | 12/1979 | Page | |
| 4,356,059 | A | * | 10/1982 | Hostetler | 162/111 |
| 4,596,633 | A | | 6/1986 | Attwood | |
| 4,883,233 | A | | 11/1989 | Saukkonen et al. | |
| 4,921,183 | A | | 5/1990 | Saukkonen et al. | |
| 5,026,458 | A | | 6/1991 | Beuther | |
| 5,150,850 | A | | 9/1992 | Adams | |
| 5,308,008 | A | | 5/1994 | Ruegg | |
| 5,377,428 | A | | 1/1995 | Clark | |
| 5,377,931 | A | | 1/1995 | Dorfel et al. | |
| 5,400,707 | A | | 3/1995 | Neider et al. | |
| 5,544,841 | A | | 8/1996 | Didier et al. | |
| 5,593,545 | A | * | 1/1997 | Rugowski et al. | 162/118 |
| 5,891,309 | A | * | 4/1999 | Page et al. | 162/111 |
| 5,895,007 | A | | 4/1999 | Moller et al. | |
| 5,918,830 | A | | 7/1999 | Verajankorva et al. | |
| 5,931,406 | A | | 8/1999 | Siebert | |
| 5,944,273 | A | * | 8/1999 | Lin et al. | 242/160.4 |
| 5,954,291 | A | | 9/1999 | Meinecke et al. | |
| 6,183,601 | B1 | * | 2/2001 | Otto et al. | 162/204 |
| 6,196,492 | B1 | | 3/2001 | Baumeister | |
| 6,398,916 | B1 | * | 6/2002 | Klerelid | 162/290 |
| 6,447,640 | B1 | * | 9/2002 | Watson et al. | 162/101 |

FOREIGN PATENT DOCUMENTS

| | | |
|---|---|---|
| WO | WO 01/06241 A1 | 1/2001 |

* cited by examiner

*Primary Examiner*—Steven P. Griffin
*Assistant Examiner*—Eric J. Hug
(74) *Attorney, Agent, or Firm*—Alston & Bird LLP

(57) ABSTRACT

A dry end of a tissue machine is made shorter by close-coupling a reel-up to the drying section and supporting the web from the drying section to the reel-up by a foil or a belt such that web stability is maintained, thus allowing high-speed operation. The foil's downstream edge can form a nip with the paper roll and nip load can be controlled by controlling pivotal movement of the foil. The reel-up can include a calendering belt for calendering the web as it passes through a nip between the belt and a reel drum supported on the belt, and a rotatable reel spool on which a paper roll is wound in nipping engagement with the reel drum. Alternatively, the reel drum can be eliminated and the paper roll can be supported on the belt. A composite shaft-less core for winding is also disclosed.

8 Claims, 33 Drawing Sheets

SHORTENED LAYOUT FROM DRYER TO REEL IN TISSUE MACHINE

CROSS-REFERENCE TO RELATED APPLICATION

The present application claims the benefit of the filing date of U.S. Provisional Application No. 60/214,507 filed Jun. 28, 2000.

FIELD OF THE INVENTION

The invention relates to papermaking machinery and methods. The invention relates more particularly to improvements in the dry end of a tissue machine enabling a close coupling between a dryer and a reel-up where the finished paper web is wound into a roll and enabling improved control of nip load in the reel-up.

BACKGROUND OF THE INVENTION

In the production of high-quality tissue, machine speed and efficiency are often limited by the performance of the dry end of the machine between the final dryer and the winding station or reel-up. Tissue is extremely delicate and difficult to handle, especially at high machine speeds. As the machine speed is continually pushed higher and higher in an effort to improve productivity, it becomes increasingly difficult to move the tissue web from the dryer to the reel-up without encountering handling problems. In a typical tissue machine, the web is creped from a Yankee dryer by a creping doctor and is then carried in a partly open or free draw to the reel-up. Located in this free draw is a measuring frame supporting measuring equipment for measuring properties of the web such as basis weight and moisture content. The dry end of the machine frequently also includes calendering equipment. In many tissue machines, the free draw tends to be quite long, which exacerbates the problem of handling the web. The web typically is guided to a reel drum that forms a nip with a growing paper roll wound on a reel spool of the reel-up. In most cases, the reel drum is mounted in a fixed position and the reel spool is movable for controlling the nip load in the reel-up.

The conventional type of tissue machine described above has a number of drawbacks that limit the machine speed and/or the quality of the tissue and the uniformity of the properties of the wound roll. The long distance between the creping doctor and the reel-up is conducive to aerodynamic instabilities of the web, which can cause web breaks and other problems. The web stability problems typically necessitate supporting equipment to stabilize the web. The supporting equipment commonly consists of a relatively sophisticated series of foils and/or guide rolls. The long dry end also means that the machine has a relatively large footprint.

Another problem associated with the conventional tissue machine is that because of the great weight of the paper roll it is very difficult to accurately control the nip load by moving the reel spool on which the paper roll is wound. Consequently, nonuniformities in the winding qualities of the paper roll can arise.

SUMMARY OF THE INVENTION

The above needs are met and other advantages are achieved by the present invention, which provides apparatus and methods for a dry end of a tissue machine enabling the length from the dryer to the reel-up to be shortened substantially, thus alleviating many of the problems associated with long dry ends as noted above. According to one aspect of the invention, an apparatus for a dry end of a tissue machine includes a rotatable reel spool onto which the paper web is wound to form a paper roll, and a stabilizing foil assembly extending from the dryer to the paper roll. The foil assembly in some embodiments has a downstream edge that forms a nip with the paper roll through which the paper web is guided onto the paper roll. In other embodiments, the foil does not form a nip with the paper roll, in which case there can be a very short free draw between the downstream edge of the foil and the paper roll. Where the foil assembly forms a nip with the paper roll, the foil assembly can be movable relative to the reel spool for controlling the nip load in the nip. Advantageously, the foil assembly can be rotatable about a pivot axis for controlling the nip load. Alternatively or additionally, the foil assembly can include a downstream edge portion that is flexible and bears against the paper roll to form the nip. The flexible edge portion can be backed up by a movable support member whose positioning is controlled for controlling the nip load, or the foil assembly or the downstream portion thereof can be pivotally movable for controlling the nip load. In some embodiments, the foil assembly comprises a single foil that extends from the dryer to a position proximate the paper roll in the winding position; in other embodiments, the foil assembly comprises two (or more) foils that collectively extend from the dryer to the paper roll.

Preferably, one or more measuring sensors are disposed proximate the foil for measuring properties of the paper web such as basis weight and moisture. The sensor or sensors can be supported by the foil or on a structure mounted adjacent the foil. The sensors can include a traversing sensor that is movable in the cross-machine direction for measuring web properties at various locations along the cross-machine direction. The sensor can be mounted adjacent an opposite side of the foil from the web, in which case the foil can include a slot aligned with the sensor so that the sensor can view the web. The foil can include a movable cover for covering the slot when the sensor is not measuring web properties. The foil can be an ordinary foil, or alternatively can be an active foil that creates a directed air flow for supporting and assisting the paper web's movement.

In some embodiments of the invention, the dryer of the paper machine includes a Yankee dryer as the final drying device, and the web is scraped from the Yankee dryer by a creping doctor. The reel spool is rotatably driven and can be positioned, in some embodiments, in an upper position with respect to the foil. In the upper position, the reel spool rotates in the opposite direction to that of the dryer roll from which the web is creped, and the downstream edge of the foil guides the web onto the lower side of the paper roll. In other embodiments, the reel spool is in a lower position relative to the foil, in which case the reel spool rotates in the same direction as the dryer roll and the foil guides the web onto the upper side of the paper roll.

In another aspect of the invention, an apparatus for the dry end of the machine includes a rotatable reel drum mounted adjacent the reel spool so as to form a nip with a growing paper roll wound on the reel spool, the paper web being supported and guided onto the paper roll by the reel drum. A calendering belt forms a calendering nip with the reel drum for calendering the paper web, the paper web passing through the calendering nip prior to being wound onto the paper roll. The load in the calendering nip can be controlled by varying the belt tension.

In accordance with still another embodiment of the invention, the dry end includes a rotatably driven reel spool for winding the paper web thereon located downstream of the dryer, a belt stretched between at least a pair of spaced-apart guide rolls and forming a nip with a growing paper roll wound on the reel spool, and a stabilizing foil for supporting and stabilizing the paper web exiting from the dryer. The foil has an upstream end adjacent the dryer and a downstream end proximate the nip such that the paper web is supported by the foil from the dryer to the nip.

In a still further embodiment of the invention, the foil can be eliminated and its stabilizing function can instead be performed by the belt. The belt is looped about a plurality of guide rolls, a first of the guide rolls being positioned proximate the dryer and spaced upstream of a growing paper roll wound on the reel spool, and a second of the guide rolls being positioned adjacent the paper roll. A portion of the loop of the belt between the first and second guide rolls extends from a location proximate the dryer to the paper roll. This portion of the loop stabilizes the paper web and guides the paper web onto the paper roll at a nip formed between the belt and the paper roll.

The invention can also be practiced in tissue machines having one or more through-air dryers (TADs) as the final drying devices. In one embodiment, the paper web is carried, supported on a TAD fabric forming an endless loop, through one or more TAD units. The TAD fabric carrying the web thereon exits the last TAD unit and is guided by guide rolls such that the TAD fabric forms a nip with a building paper roll in the reel-up, thus guiding the web onto the building paper roll. Accordingly, the paper web is continuously supported by the TAD fabric from the dryer to the reel-up.

The invention also encompasses improvements in controlling the nip load in the reel-up. In some embodiments, a reel-up includes a rotatable reel spool mounted in a fixed location, and a movable reel drum forming a nip with the paper roll on the reel spool. Nip load is controlled by moving the reel drum. The weight of the reel drum is constant during winding, unlike that of the paper roll. Consequently, it is much easier to control the nip load accurately by moving the reel drum than by moving the variable-weight paper roll. Moreover, the reel drum can be made much lighter in weight than the paper roll, which further facilitates accurate nip load control since it is easier to move a light-weight drum accurately than it is to do so with a heavy paper roll.

In other embodiments, the reel-up includes a holder that holds the reel spool and is pivotable about a pivot arrangement that is movable for controlling the nip load in the reel-up. The nip load in an advantageous method embodiment of the invention is controlled by moving the pivot arrangement with a component of movement that is parallel to a plane in which the axes of the reel spool and the reel drum lie. When the paper roll on the reel spool is fully wound, the holder can be rotated about the pivot arrangement to deliver the paper roll to a further processing station, for example by releasing the reel spool and paper roll onto rails or other suitable supports along which the paper roll can be moved.

The invention in other embodiments also provides a composite shaftless core that can be used in place of the steel core shaft and paper core conventionally used for winding paper. The composite shaftless core can be constructed of a fiber-matrix composite material and advantageously includes metal bushings or fittings at the ends for connection with chucks and/or drive units. The metal fittings may include teeth or splines for engagement by drive units. The composite shaftless core can be used directly in further operations such as converting, thus eliminating the need for rewinding before converting. In a preferred embodiment of the invention, the tubular side wall of the composite shaftless core is perforated with holes and the shaft can be connected to a vacuum source in order to create an under-pressure inside the shaft to cause a paper web to be suctioned against the shaft at the start of a winding operation.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
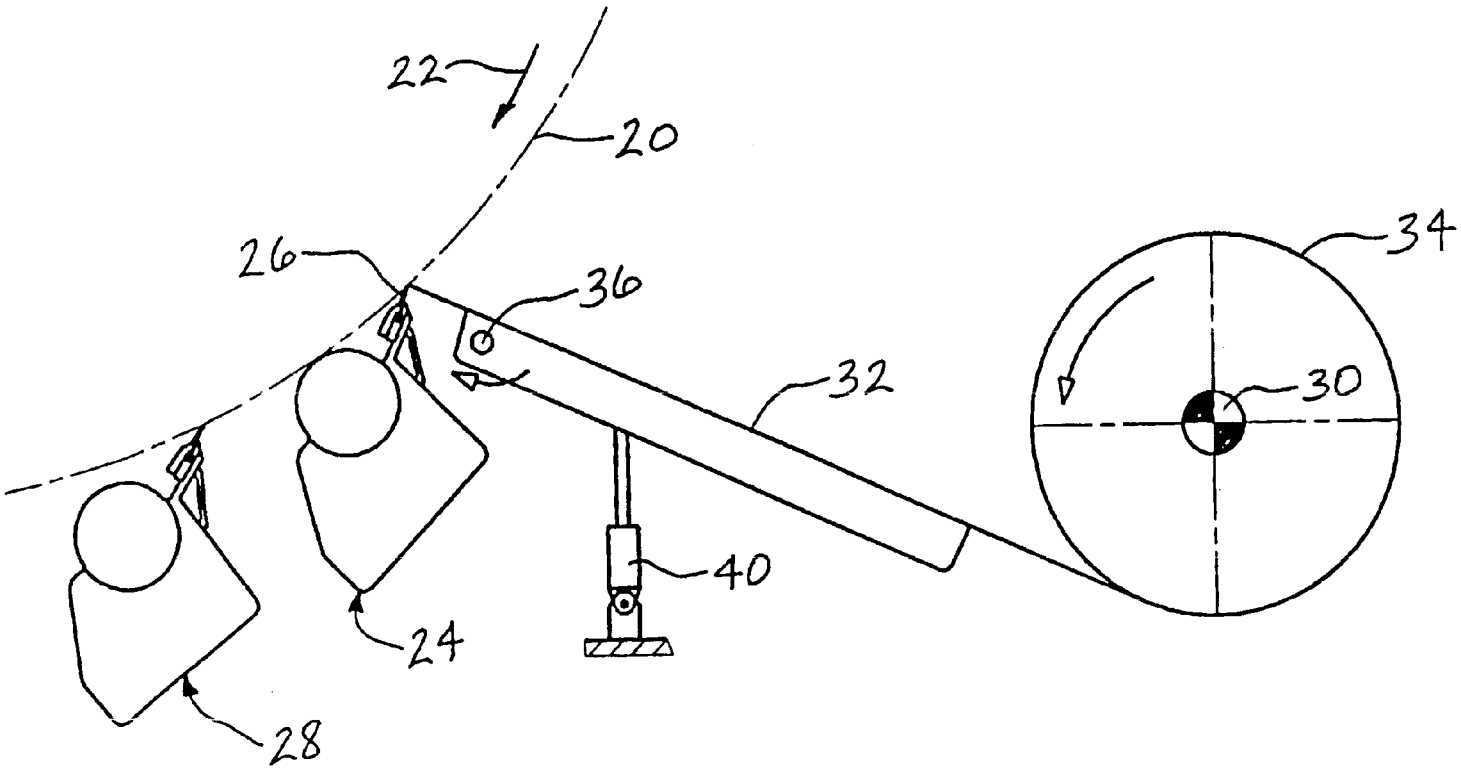
FIG. 1 is a diagrammatic depiction of a dry end of a paper machine in accordance with one embodiment of the invention having a driven reel spool closely coupled to the creping doctor with a stabilizing foil therebetween, with the reel spool in an upper position relative to the foil.
Figure 1A:
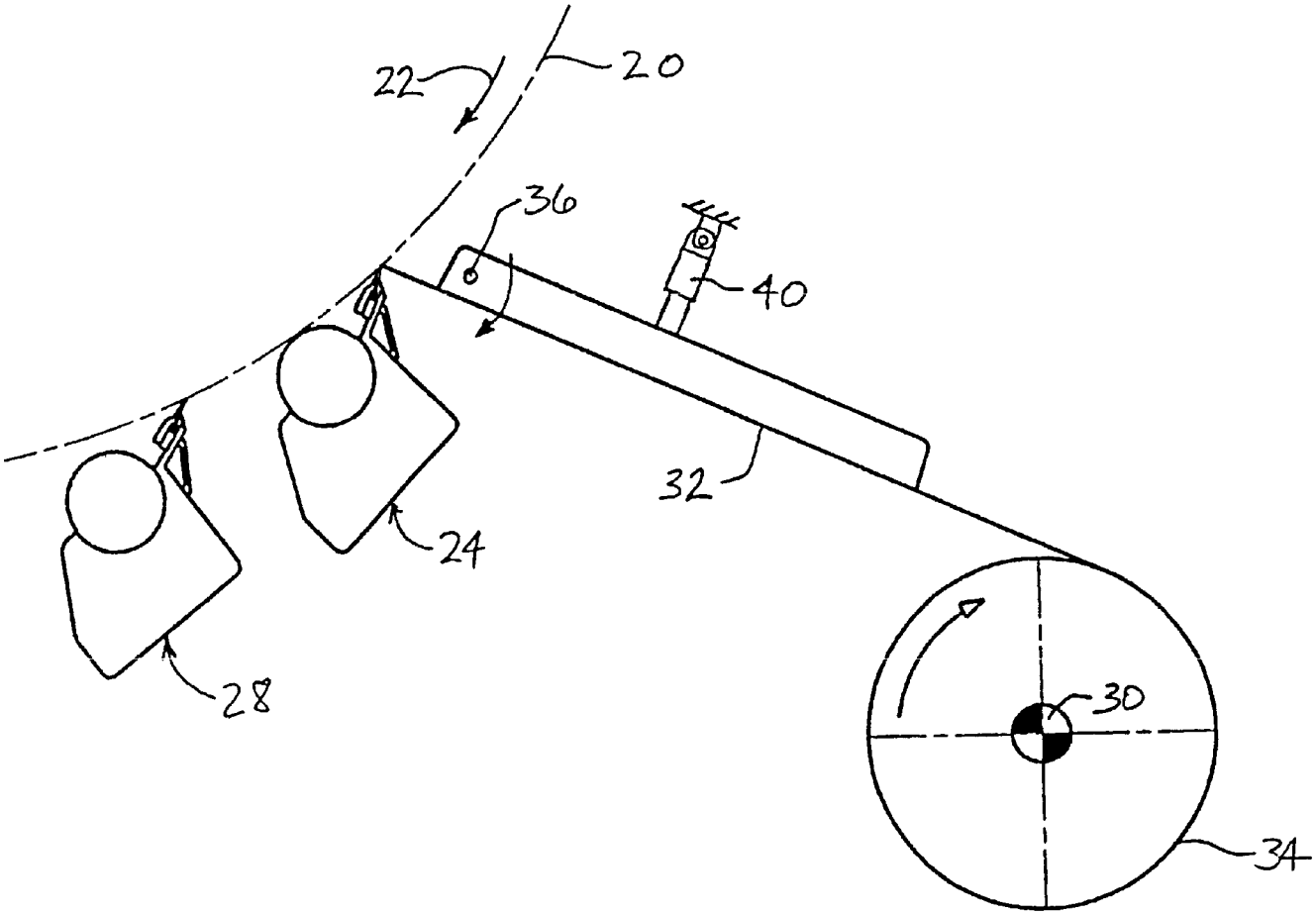
FIG. 1A is a view similar to FIG. 1, but with the reel spool in a lower position relative to the foil.

FIGS. 1 and 1A depict the dry end of a papermaking machine in accordance with a first pair of related embodiments of the invention. The paper web, as is conventional, is dried on a Yankee dryer having a heated dryer roll 20 rotating in the direction of arrow 22. The web is removed from the roll 20 and preferably creped by a creping doctor 24 having a doctor blade 26. A cleaning doctor 28 arranged after the creping doctor cleans the surface of the roll. Alternatively, the doctor 28 can be used for removing and creping the paper web from the roll 20 when the doctor 26 is out of service for replacement or maintenance. The web creped from the dryer roll 20 proceeds over a short draw to a driven reel spool 30 rotating in the opposite direction to that of the dryer roll 20 in the embodiment of FIG. 1, and rotating in the same direction as the dryer roll in the embodiment of FIG. 1A. In the draw between the creping doctor 24 and the reel spool 30, the web is stabilized by a foil 32 having its upstream edge adjacent the creping doctor blade 26 and its downstream edge proximate the paper roll 34 building on the reel spool 30. The foil 32 advantageously extends across the full width of the paper web in the cross-machine direction. The foil 32 is mounted so as to be rotatable about a pivot axis 36 located near the upstream edge of the foil and extending parallel to the cross-machine direction. Thus, the foil can be pivoted to keep the downstream edge of the foil in a desired position relative to the growing paper roll 34. An actuator 40 provides the actuation force pivoting the foil 32 as the paper roll grows. In the embodiments of FIGS. 1 and 1A, the foil 32 acts to suppress flutter of the web, which can occur particularly with webs of low basis weight traveling at high speeds. The foil 32 can be an ordinary passive foil comprising a generally planar surface along which the web travels, or alternatively can be an active foil that uses pressurized air to create a directed air flow for supporting and assisting the web's movement. Such an active air foil is described, for example, in U.S. Pat. No. 5,738,760, the disclosure of which is incorporated herein by reference.

Figure 2:
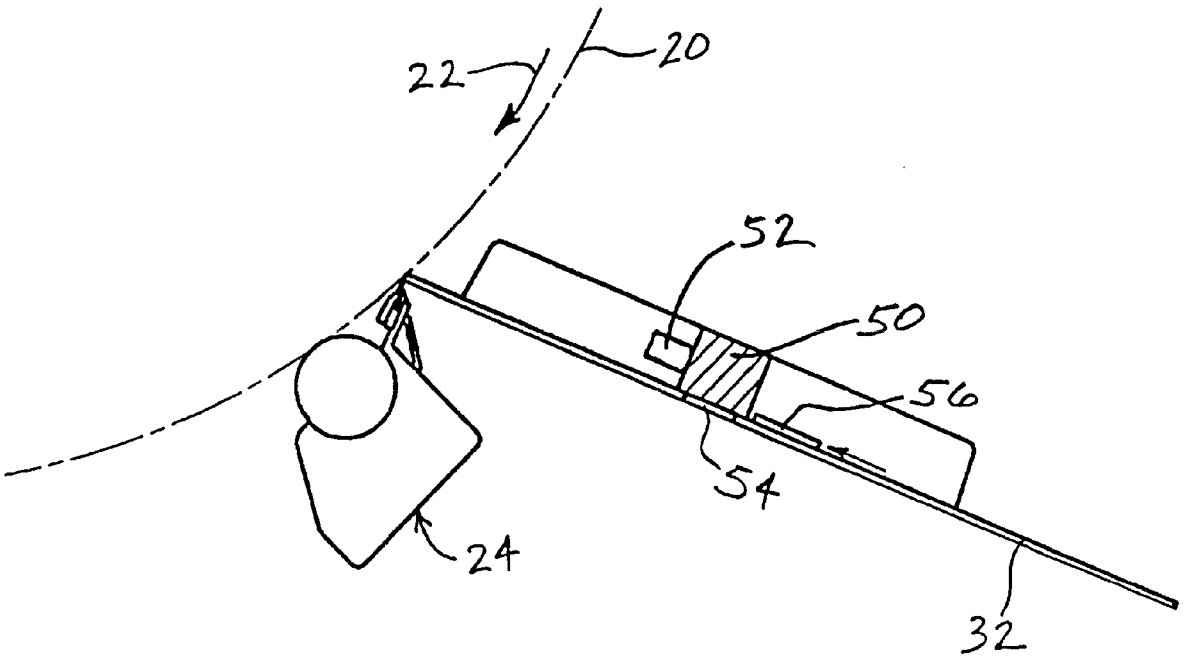
FIG. 2 shows a foil having a measuring sensor integrated therein.

FIG. 2 depicts an embodiment of a stabilizing foil 32 having a measuring head 50 integrated with it. As noted above, the foil 32 can be either passive or active. The measuring head 50 comprises at least one sensor for measuring properties of the paper web such as basis weight, which is an important parameter in the control of the papermaking process. The head 50 can incorporate more than one sensor, such as a basis weight sensor and a moisture or temperature sensor. It is desirable in general to be able to check the machine-direction and cross-machine-direction variations in basis weight. Advantageously, the measuring head 50 is traversable in the cross-machine direction along a rail 52 or the like. Where the head 50 is mounted adjacent an opposite side of the foil 32 from the paper web, the foil includes a slot 54 extending along the cross-machine direction aligned with the traversing head 50. The foil can include a movable cover 56 for covering the slot 54 when the measuring head 50 is not being used to check the basis weight of the web. The measuring foil with integrated measuring head 50 as shown in FIG. 2 can be used in the dry end arrangements shown in FIGS. 1 and 1A.

Figure 3:
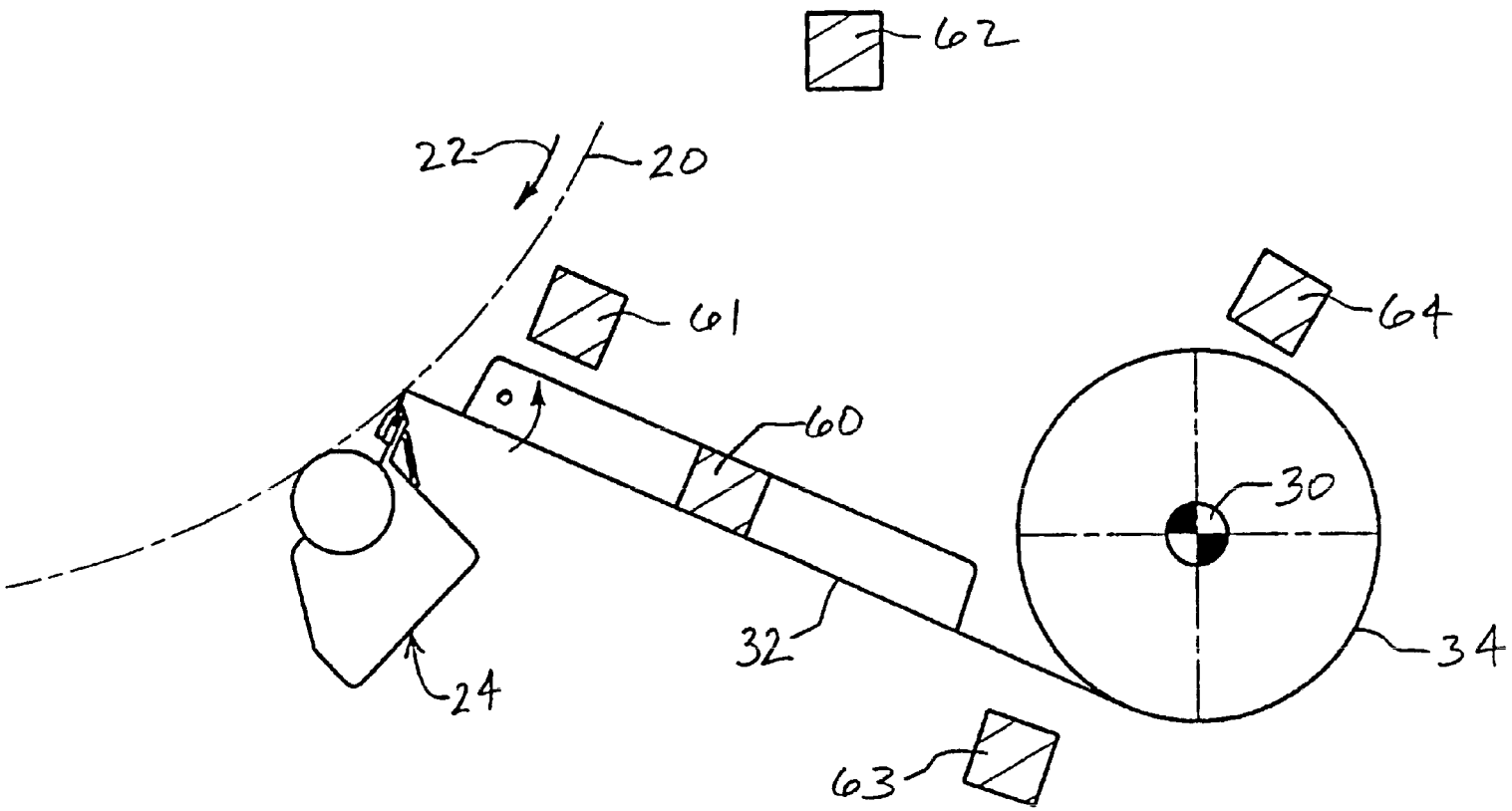
FIG. 3 is a view similar to FIG. 1 showing an embodiment in which measuring sensors are located in various positions in the region between the creping doctor and the paper roll, including a sensor supported on the foil.

FIG. 3 depicts a further embodiment of the invention generally similar to that of FIG. 1, except that a plurality of measuring sensors 60 through 64 are disposed in the dry end in various locations for measuring web properties. The sensors can be mounted on the foil 32 and/or on supporting structure for the foil and/or on other suitable structures. The sensors can measure basis weight, web temperature and/or moisture. Advantageously, the sensor 61 can comprise an infrared temperature sensor placed upstream of the creping doctor 24 for measuring web temperature prior to the web being creped from the dryer roll 20. It has been found that there is a good correlation between web temperature measured by an infrared temperature sensor and web moisture content. Accordingly, the web temperature measured by the sensor 61 can be used for determining web moisture content going into the dry end. Sensors 63 and 64 can be used for measuring the speed of the web.

Figure 4:
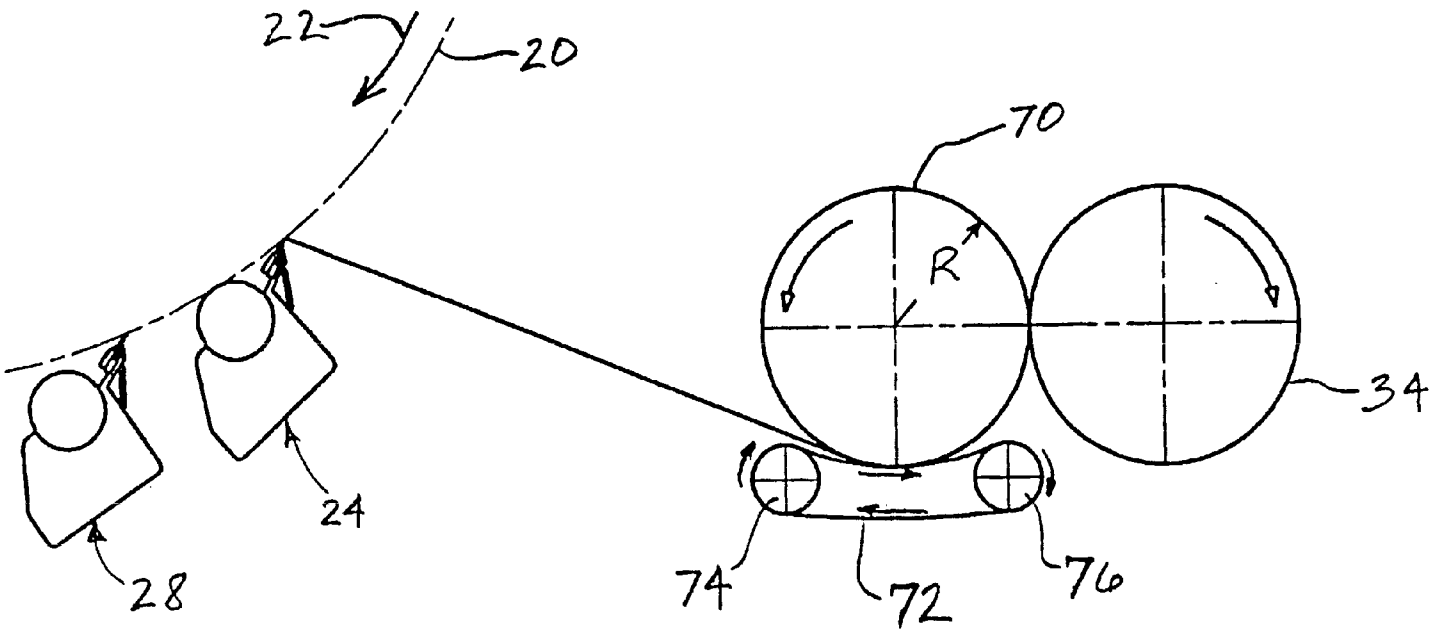
FIG. 4 depicts another embodiment of the invention having a calendering belt forming a calendering nip with a reel drum and having a reel spool for winding the paper web into a roll that forms a nip with the reel drum.

FIG. 4 shows a further embodiment of the invention. The web is creped from the dryer roll 20 by the creping doctor 24 and proceeds to a reel drum 70 located a short distance downstream from the creping doctor. The reel drum 70 is supported by a calendering belt 72 that is stretched between and guided about at least a pair of spaced-apart guide rolls 74 and 76. The web is calendered as it passes through the nip between the reel drum 70 and the calendering belt 72. The web then is wound onto a paper roll 34 that is in nipping engagement with the reel drum 70. The reel drum 70 and/or the paper roll 34 and/or the belt 72 can be rotatably driven. The belt 72 can be driven by driving the guide roll 74 and/or the guide roll 76. The linear loading in the calendering nip between the reel drum 70 and the belt 72 is a function of the tension T in the belt and the radius R of the reel drum 70 as T divided by R. Thus, the nip pressure in the calendering nip can be controlled by controlling the belt tension T.

Figure 4A:
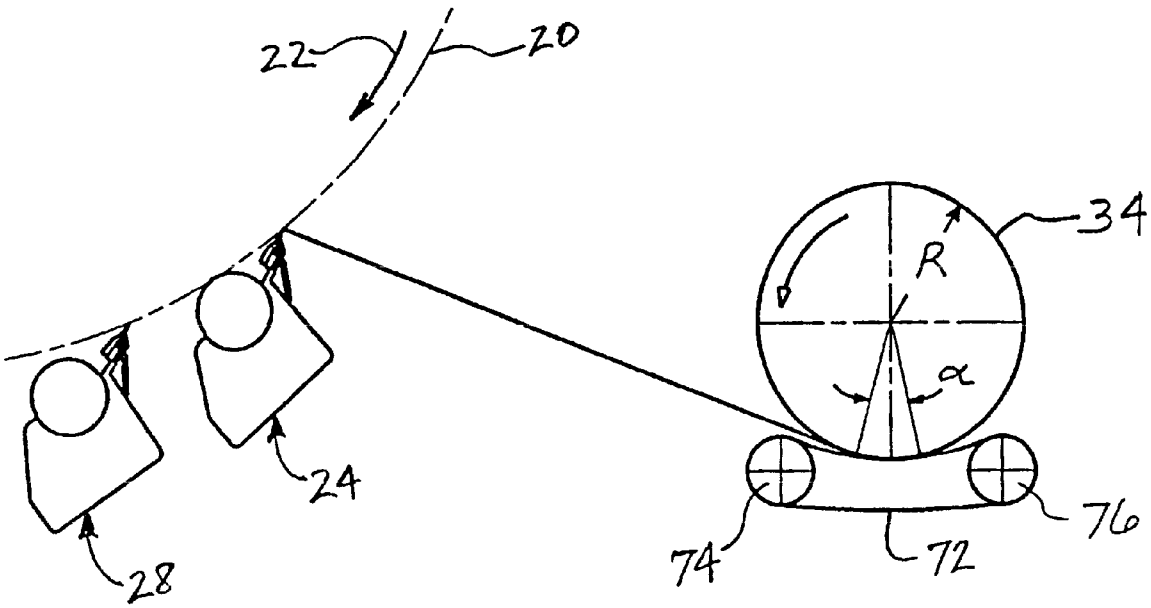
FIG. 4A shows a further embodiment of the invention having the paper roll supported on a belt stretched between two guide rolls.

FIG. 4A shows a still further embodiment of the invention similar to that of FIG. 4 except that the reel drum 70 is eliminated and the paper roll 34 is directly supported by the belt 72. The paper roll 34 and/or the guide roll 74 and/or the guide roll 76 can be driven. As before, the linear load in the nip defined between the paper roll 34 and the belt 72 is belt tension T divided by the radius R of the paper roll 34. Accordingly, the nip pressure can be controlled by measuring the paper roll radius and the belt tension in a suitable manner and controlling the tension in the belt to achieve a desired nip load. Because the paper roll is continually growing in diameter during winding, the contact angle $\alpha$ of the roll with the belt 72 and the contact area therebetween will continually change. Thus, a synchronization of the belt tension T in relation to the increase in the roll radius R is needed in order to control nip pressure.

Figure 5:
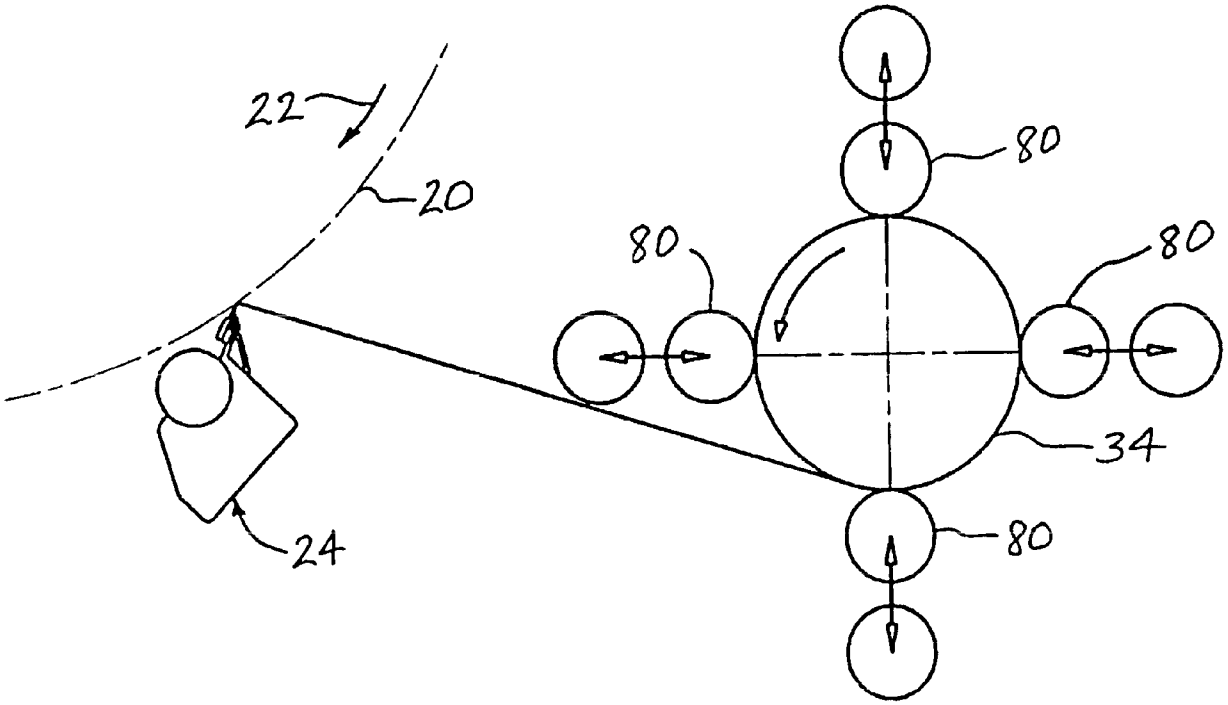
FIG. 5 shows another embodiment of the invention having a reel spool mounted in a fixed location and one or more movable reel drums nipped with the paper roll wound on the reel spool, the paper web being guided onto an upper side of the paper roll.
Figure 5A:
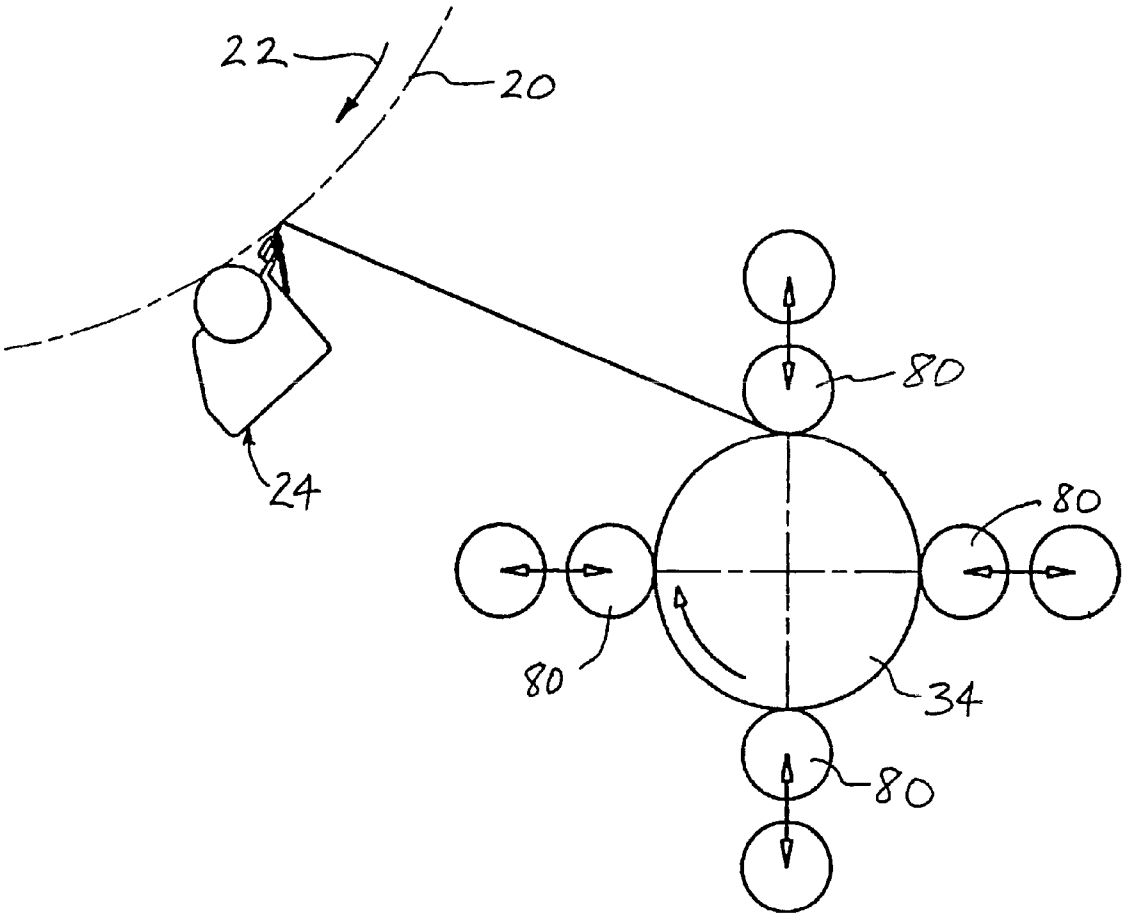
FIG. 5A shows a further embodiment similar to that of FIG. 5, but with the paper web guided onto a lower side of the paper roll

FIGS. 5 and 5A depict other embodiments of the invention in which the building paper roll 34 is located in a fixed position and is rotatably driven, while a lightweight movable winding support roll 80 is moved into nipping engagement with the paper roll 34 and is controllably positioned for controlling the nip load. As indicated, the winding support roll 80 can be located at various positions relative to the paper roll.

Figure 6:
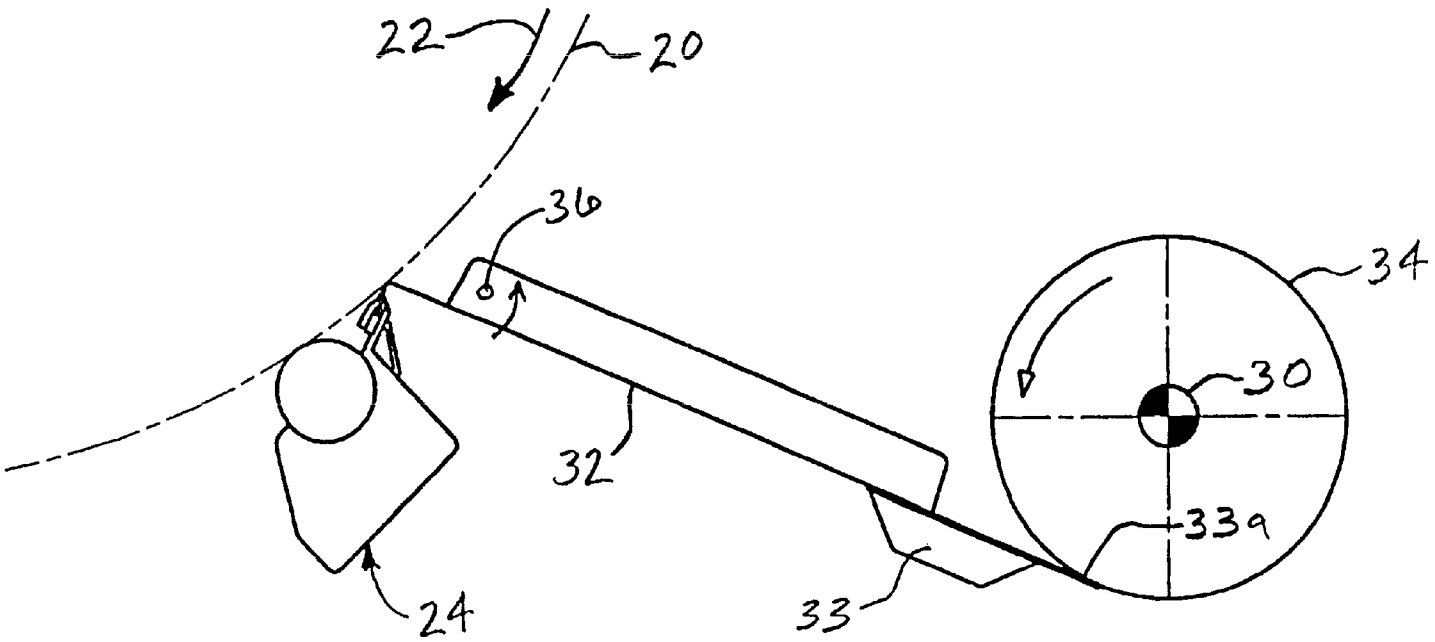
FIG. 6 depicts still another embodiment of the invention having a driven reel spool and a pair of stabilizing foils, wherein the downstream foil has a flexible edge that forms a nip with the paper roll.
Figure 6A:
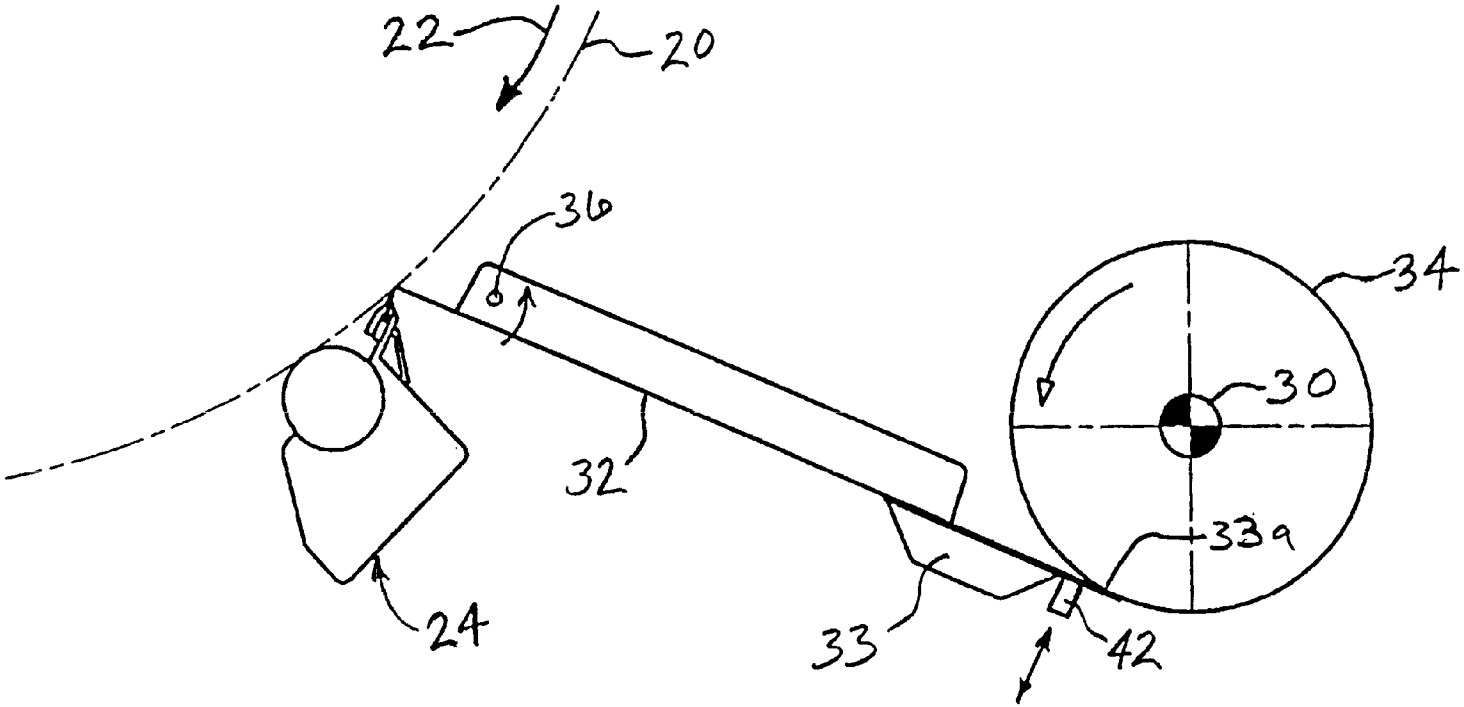
FIG. 6A shows an alternative embodiment similar to FIG. 6 but having a movable support member backing up the flexible edge of the foil.
Figure 6B:
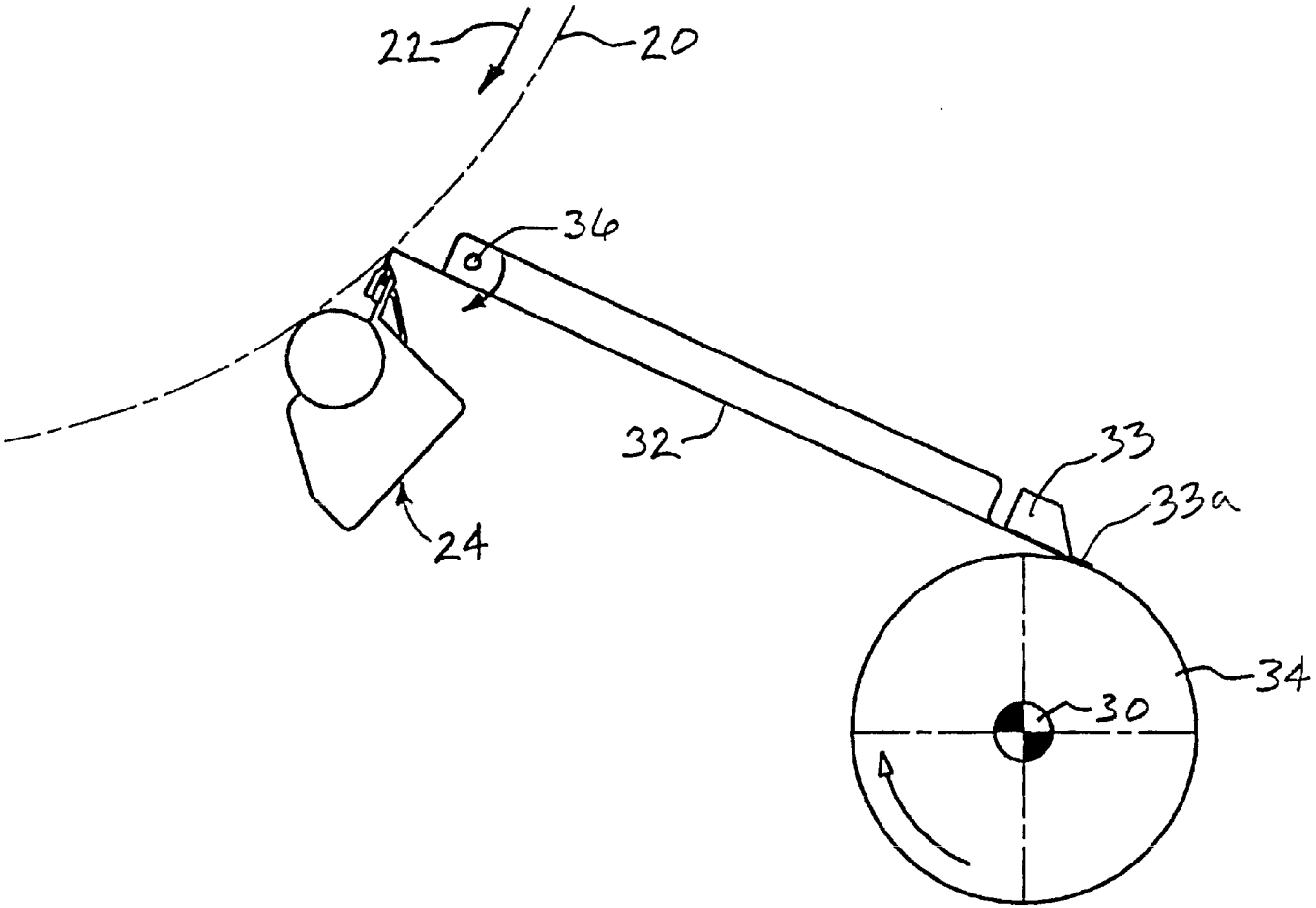
FIG. 6B depicts an embodiment of the invention having a driven reel spool and a stabilizing foil.

FIGS. 6, 6A, and 6B depict embodiments of the invention employing a pair of stabilizing foils 32 and 33. The downstream foil 33 includes a flexible downstream edge portion 33*a* that forms a nip with the paper roll 34. The flexibility of the edge portion 33*a* can be tailored to the desired winding conditions and paper properties. The downstream foil can be rigidly joined to the upstream foil 32 so that they can be pivoted together as a unit, and nip load can be controlled by controlling pivotal movement of the foil assembly 32, 33 based on the degree of flexing of the flexible edge portion 33*a* relative to the rest of the foil assembly. Alternatively, as shown in FIG. 6A, nip load can be controlled by controlling the movement of a separate movable support member 42 that backs up the flexible edge portion 33*a* based on the degree of flexing of the flexible edge portion 33*a*.

Figure 6C:
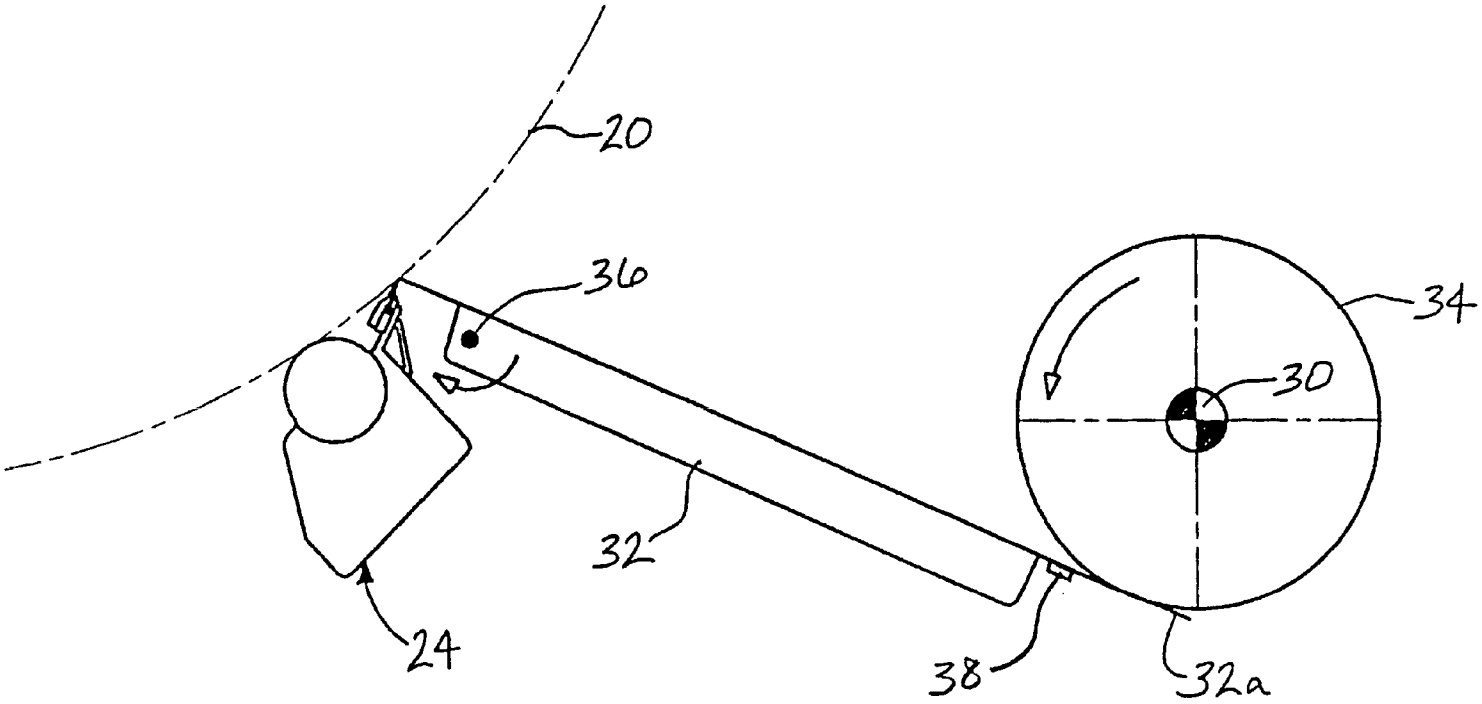
FIG. 6C depicts a further embodiment of the invention having a driven reel spool and a foil whose downstream edge is flexible and forms a nip with the paper roll.

FIG. 6C shows a further embodiment in which a single foil 32 extends from the creping doctor 24 to the winding paper roll 34, and in which the foil 32 has a downstream flexible edge 32*a* in nipping engagement with the paper roll. Nip load can be controlled by pivoting the foil 32 about its pivot axis 36. One or more sensors 38 can be mounted on the foil for measuring a suitable parameter enabling a determination of the nip load to be made. For instance, the sensor 38 can comprise a strain gauge sensor for measuring strain in the flexible edge portion 32*a* of the foil, which is related to the bending moment exerted on the flexible edge portion and hence is related to the nip load. Alternatively, a load sensor (not shown) can be incorporated into an actuator (not shown) that provides the force urging the edge of the foil against the paper roll. Other schemes for measuring the nip load can also be used, as will be apparent to those skilled in the art. The nip load may be a function of, among other things, the diameter of the paper roll 34, the paper grade, and the speed of winding. It will be noted that the rotational position of the foil 32 is directly related to the diameter of the paper roll 34, and hence the rotational position of the foil 32 can be used for determining the roll diameter and/or can be used as a parameter in the control of the nip load.

Figure 7:
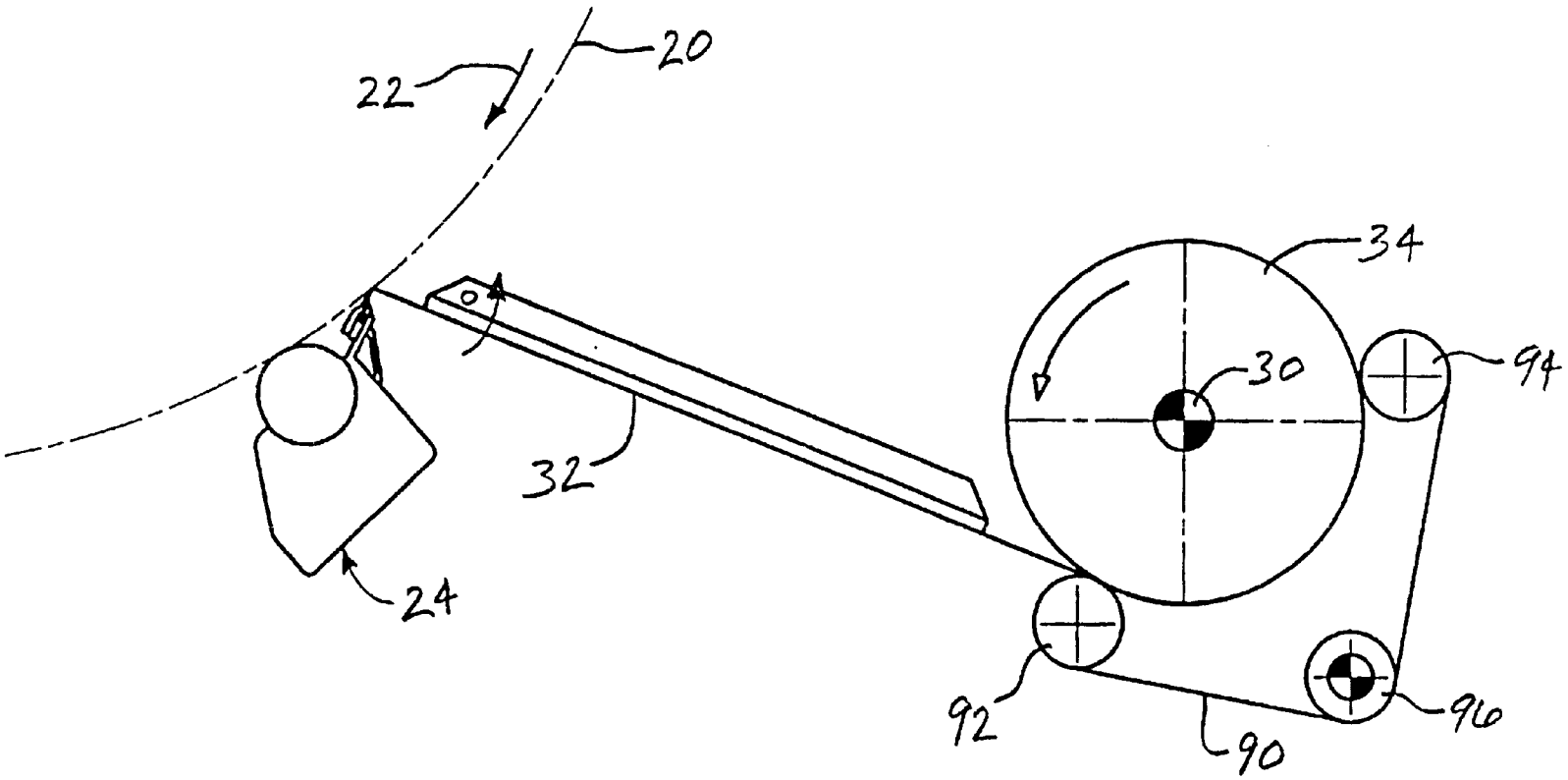
FIG. 7 shows another embodiment having a reel spool and a belt that forms a nip with the paper roll on the reel spool, and having a foil between the creping doctor and the nip for stabilizing the web, the web being guided onto a lower side of the paper roll.
Figure 7A:
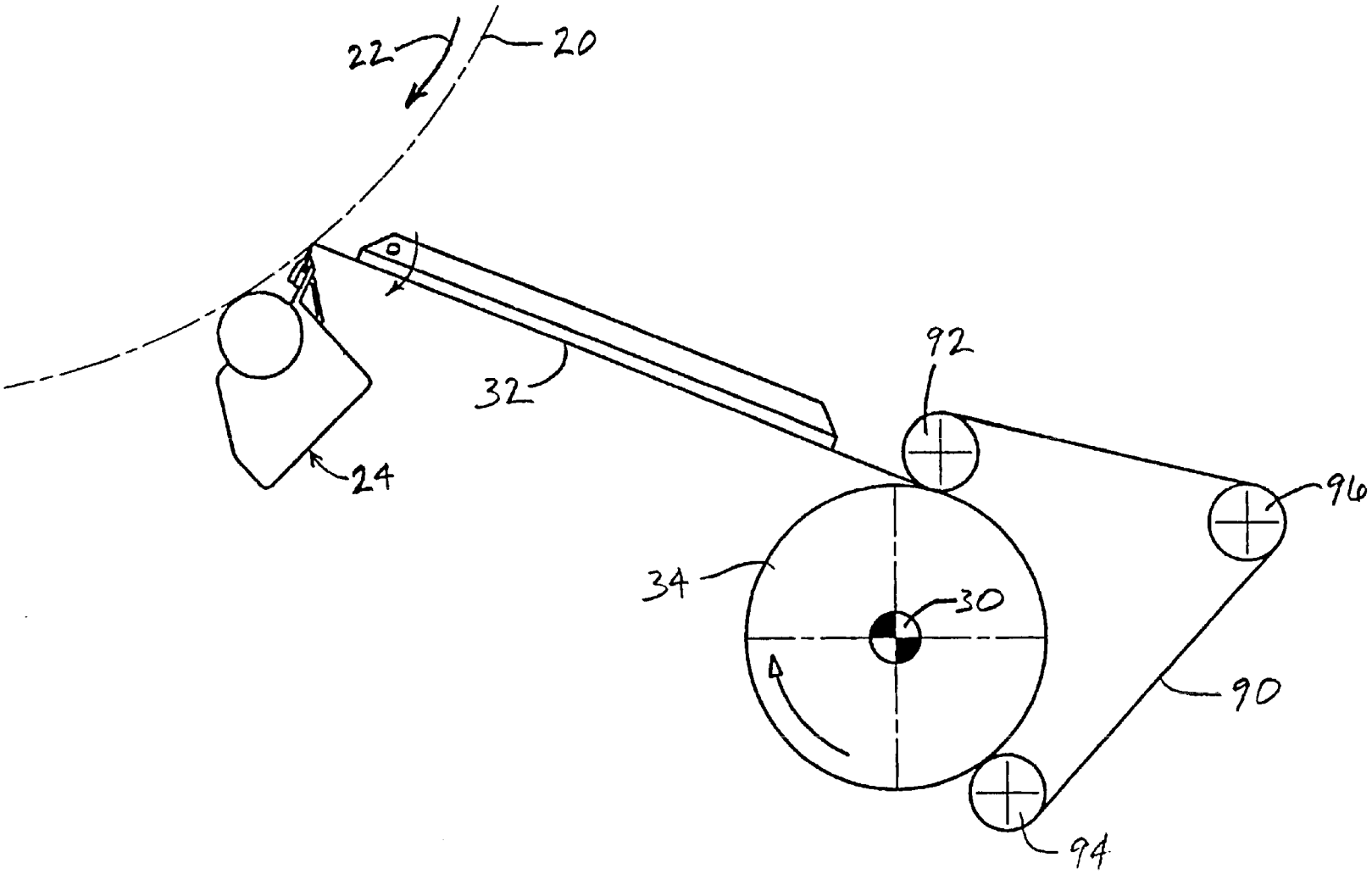
FIG. 7A shows an embodiment similar to that of FIG. 7, but with the web being guided onto an upper side of the paper roll.

FIGS. 7 and 7A depict embodiments of the invention in which the reel-up includes a rotatably driven reel spool 30 on which the paper roll 34 is wound, and a winding support belt 90 guided about a plurality of spaced-apart guide rolls 92, 94, and 96. The winding support belt 90 forms a nip with the paper roll 34. The guide roll 96 is driven for driving the belt 90. The arrangement thus is generally similar to that shown in FIG. 4A, except for the addition of a stabilizing foil 32 having its upstream edge proximate the creping doctor 24 and its downstream edge proximate the paper roll 34 for stabilizing the paper web as it travels from the creping doctor to the nip between the paper roll and the belt 90. The embodiments in FIGS. 7 and 7A differ from each other in terms of the direction of rotation of the paper roll 34, but otherwise are the same in principle.

Figure 7B:
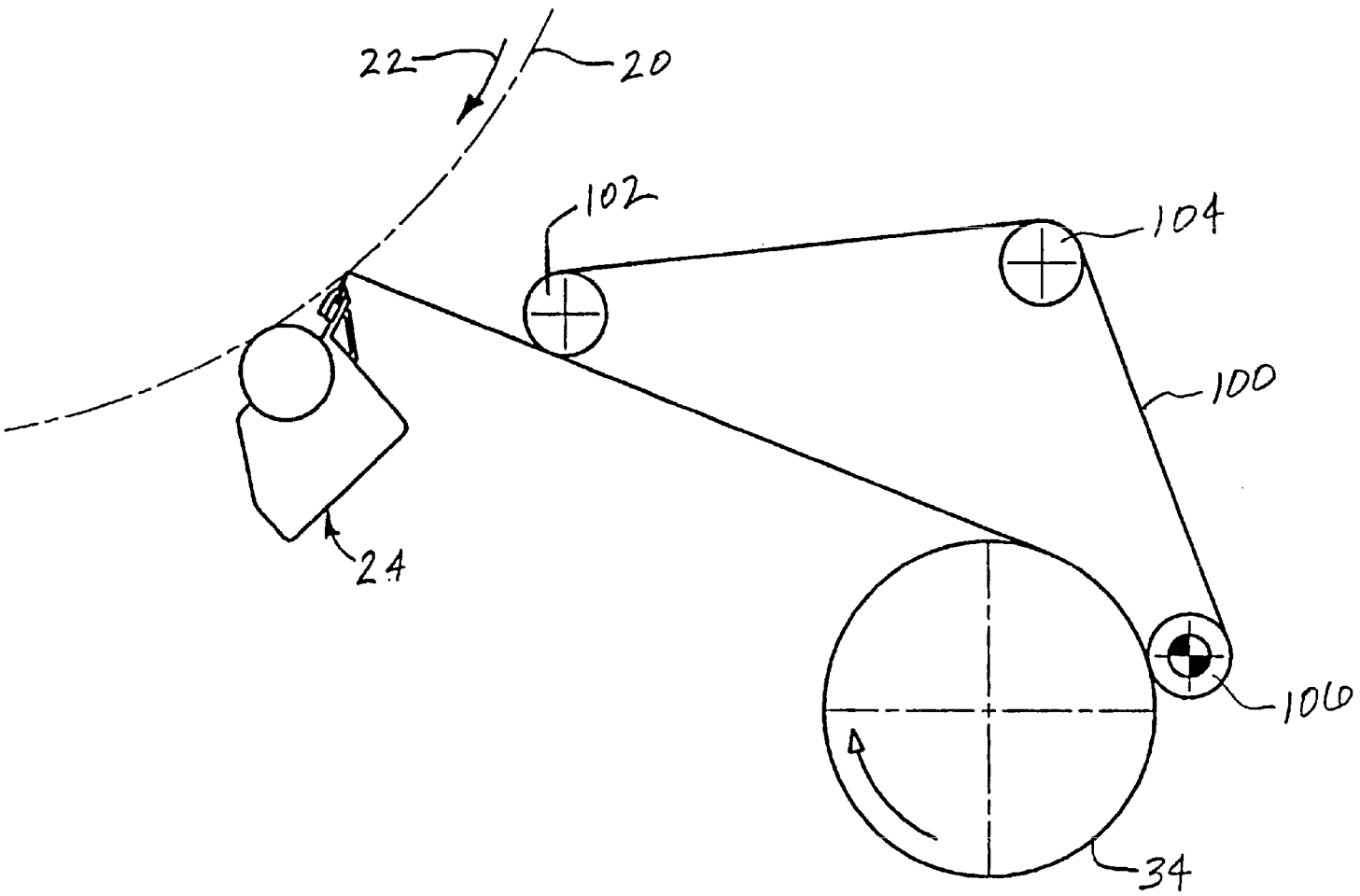
FIG. 7B depicts a further embodiment of the invention having a reel spool on which the paper roll is wound and a belt looped about a plurality of guide rolls for stabilizing the web between the creping doctor and the reel spool and for forming a nip with the paper roll.
Figure 7C:
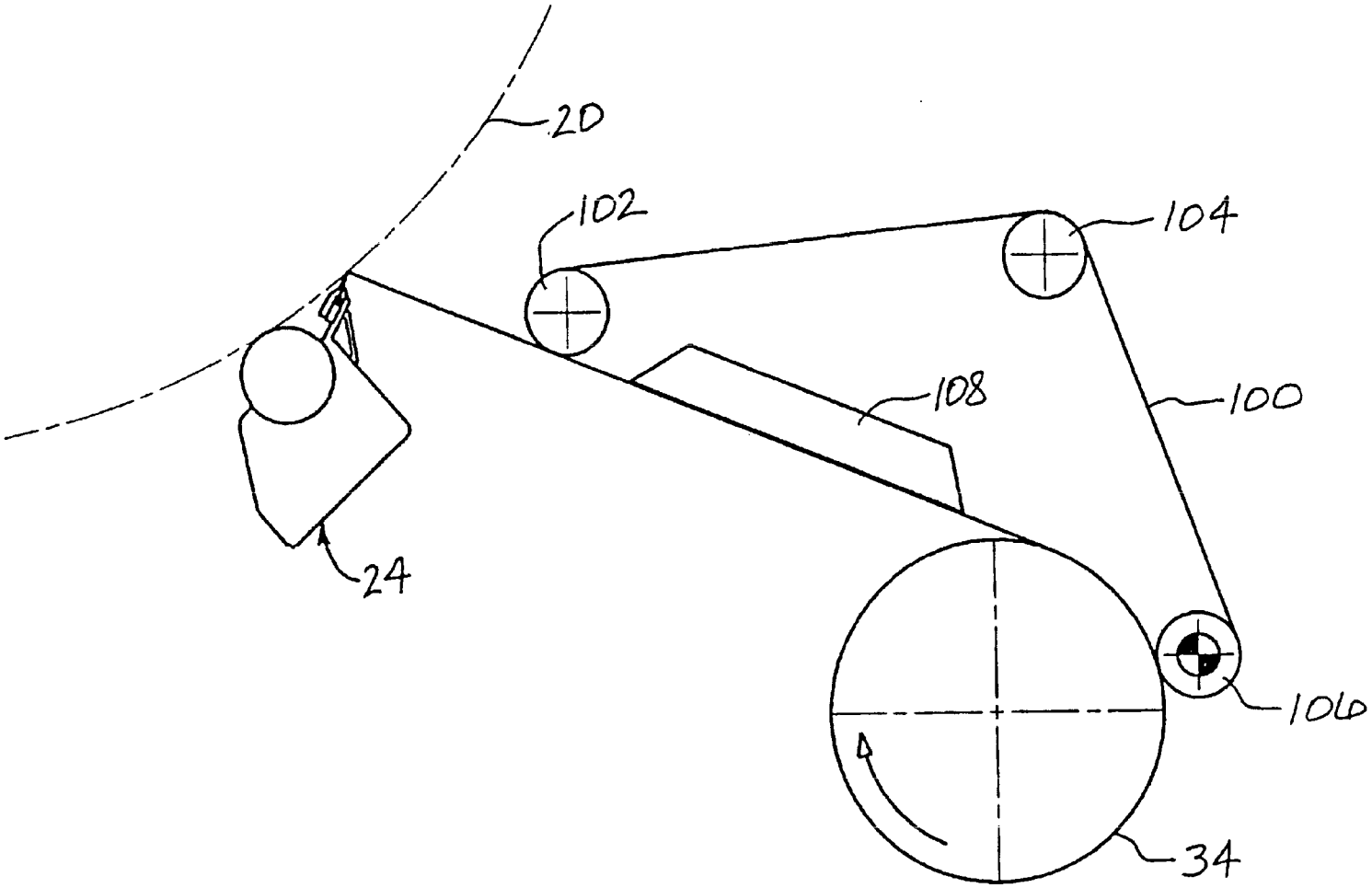
FIG. 7C shows and embodiment similar to FIG. 7B but having a permeable belt and a vacuum box disposed in the loop of the belt.

FIG. 7B depicts yet another embodiment of the invention in which the reel-up includes a belt as in the embodiments of FIGS. 7 and 7A, but the stabilizing foil is eliminated and the belt is configured to perform the stabilizing function of the foil. The belt 100 is looped about a plurality of guide rolls 102, 104, and 106, the guide roll 106 being rotatably driven for driving the belt. The guide roll 106 is located adjacent the building paper roll 34. The guide roll 102 is spaced upstream from the paper roll 34 and a short distance downstream from the creping doctor 24. The portion of the loop of the belt between the guide roll 102 and the guide roll 106 acts to stabilize the web as it travels from the creping doctor to the nip defined between the belt 100 and the paper roll 34. FIG. 7C shows a variant in which a device 108 for creating an underpressure is disposed within the loop of the belt 100; in this embodiment, the belt 100 should be permeable. The device 108 can be a vacuum box, or alternatively can be a device that creates an underpressure by blowing air via the Coanda effect, such as a device marketed by Valmet Corporation under the trademark Blowbox.

Figure 7D:
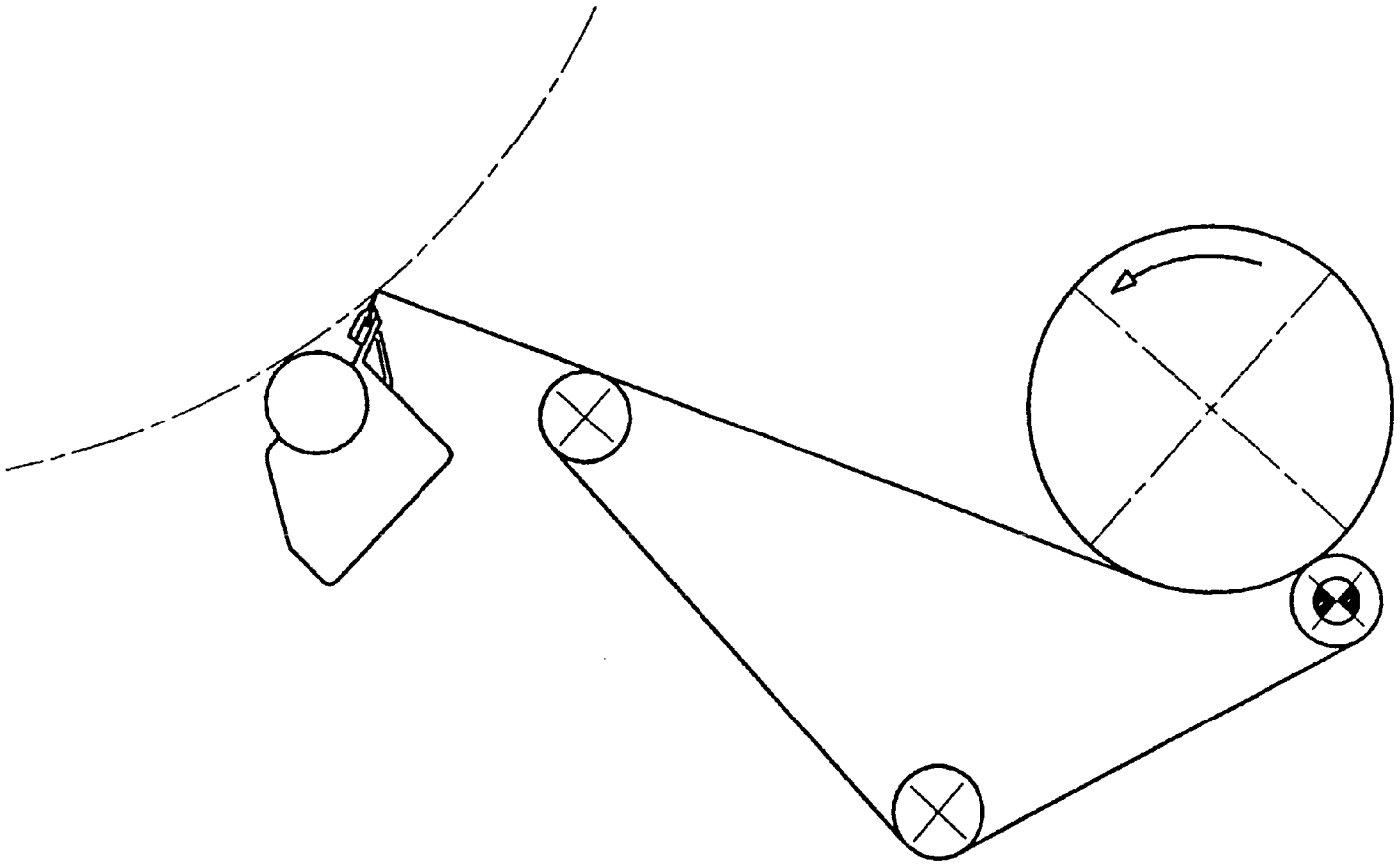
FIG. 7D is an embodiment similar to FIG. 7B, but with the paper roll in an upper position with respect to the belt.
Figure 7E:
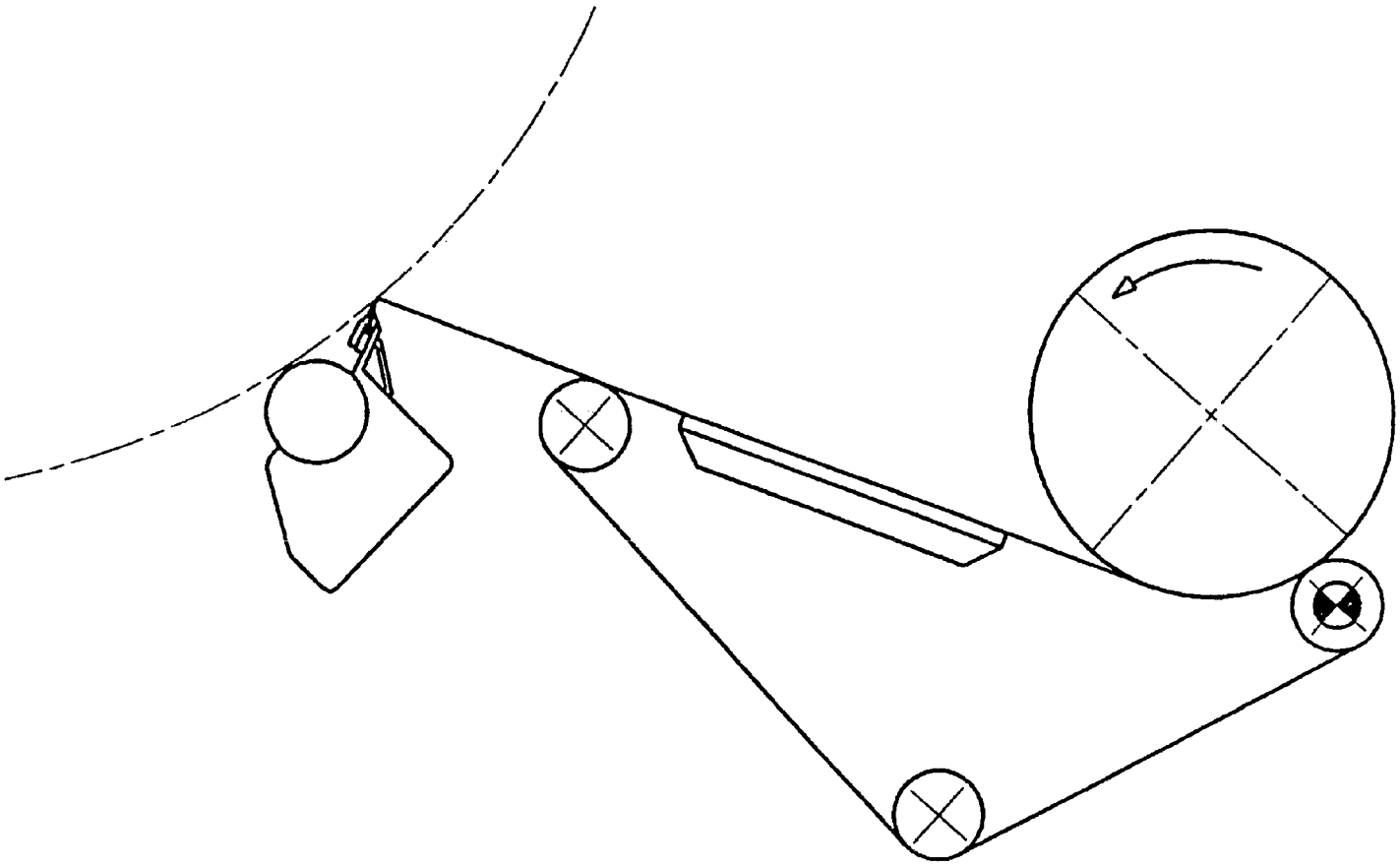
FIG. 7E is an embodiment similar to FIG. 7C, but with the paper roll in an upper position with respect to the belt and vacuum box.

FIGS. 7D and 7E depict variants of the embodiments of FIGS. 7B and 7C, respectively, the difference being that the paper roll 34 is located in an upper position with respect to the belt 100 rather than a lower position. In other respects, the embodiments of FIGS. 7D and 7E are similar to those of FIGS. 7B and 7C. However, it should be noted that an advantage of the embodiments of FIG. 7D and 7E is that the paper web is supported on an upper surface of the belt 100 downstream of the creping doctor 24, and thus is prevented by the belt from falling downward.

Figure 7F:
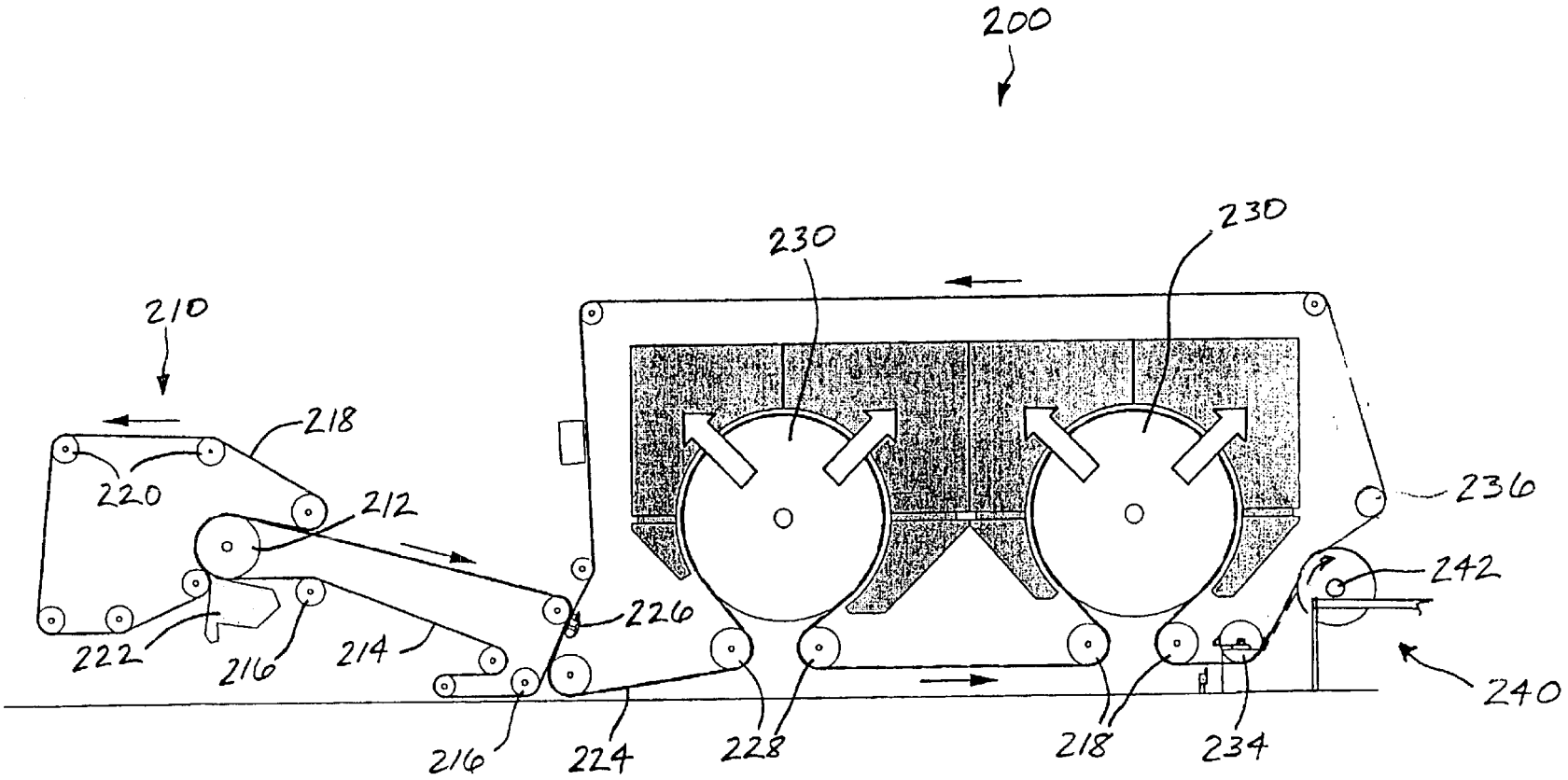
FIG. 7F depicts yet another embodiment of the invention having TAD units as the final dryer devices.

It will be appreciated by persons skilled in the art that the principles of the invention are not limited to being applied in paper machines employing a Yankee dryer as the final dryer device, but can also be applied in other types of machines such as those employing one or more through-air dryer (TAD) units as the final dryer(s). As but one example, FIG. 7F shows a paper machine 200 in accordance with a preferred embodiment. The machine 200 includes a forming section 210 having a twin-wire former. The former includes a forming roll 212, an inner wire 214 formed in an endless loop about guide rolls 216 such that the inner wire passes about a sector of the forming roll, an outer wire 218 formed in an endless loop about guide rolls 220 such that the outer wire passes about the sector of the forming roll on top of the inner wire, and a head box 222 that discharges an aqueous suspension of papermaking fibers between the inner and outer wires just upstream of the forming roll so as to form a wet paper web between the wires. The wet web is partially dewatered by being pressed between the wires as they pass about the forming roll, and the partially dewatered web is separated from the outer wire and is carried on the inner wire 214 downstream of the forming roll to a web transfer point. At the web transfer point, the web is transferred from the inner wire 214 onto a TAD fabric 224 with the aid of a suction device 226 disposed inside the loop of the TAD fabric. The TAD fabric 224 travels in an endless loop about guide rolls 228. The TAD fabric carrying the web thereon passes about a foraminous dryer roll 230 of each of a pair of outward-flow TAD units. An exhaust hood 232 surrounds the portion of each dryer roll 230 about which the TAD fabric and web pass. In conventional fashion, drying air is supplied from the interior of each dryer roll 230 radially outward through the foraminous mantle of the roll and thus through the web and TAD fabric, and is exhausted by the exhaust hoods.

The TAD fabric downstream of the second TAD unit carries the web on the outward-facing surface of the fabric. The fabric in this location extends between a pair of guide rolls 234, 236 that are disposed respectively upstream and downstream of a winding station of a reel-up 240. The reel-up includes appropriate equipment (not shown) operable to grip and rotatably drive a reel spool 242 about which the paper web is to be wound, and operable to urge the rotatably driven reel spool against the TAD fabric 224 so as to form a nip therebetween. The paper web carried on the TAD fabric passes into this nip and is thus wound onto the reel spool to build a paper roll. The reel-up is operable to move the reel spool as the paper roll builds so as to compensate for the increasing diameter of the roll. It will be appreciated that the paper machine according to FIG. 7F offers a number of advantages. First, the paper web is supported at all times on a wire or fabric, such that there are no free draws. Second, the overall length and footprint of the machine can be made small because the reel-up 240 can be close-coupled to the last TAD unit.

Figure 8A:
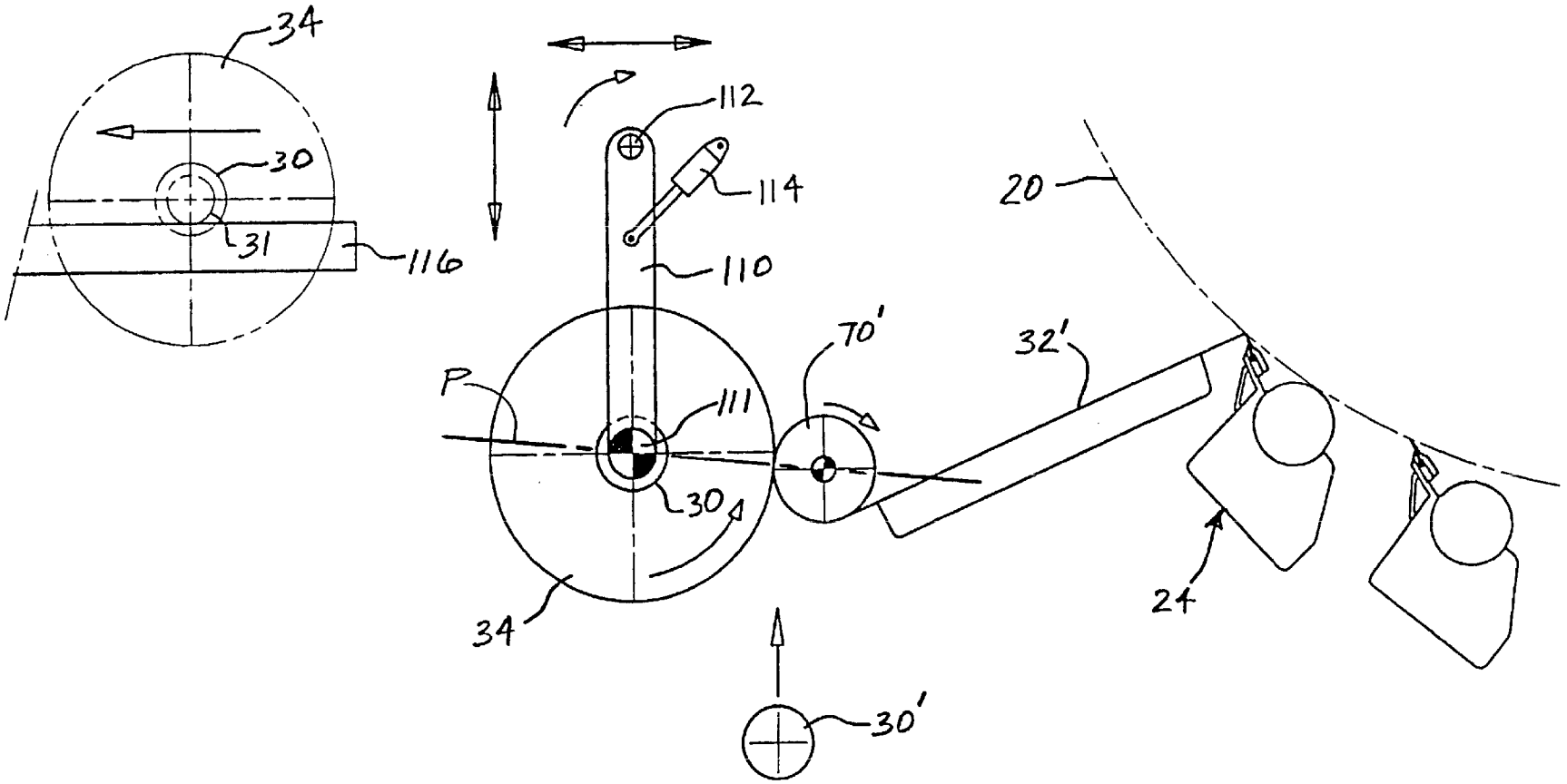
FIGS. 8A through 8C depict a series of sequential views of a reel-up and changeover operation in accordance with another embodiment of the invention having a reel spool on which the paper roll is wound supported by a holder pivotally suspended from a pivot arrangement that is horizontally and vertically movable.
Figure 8B:
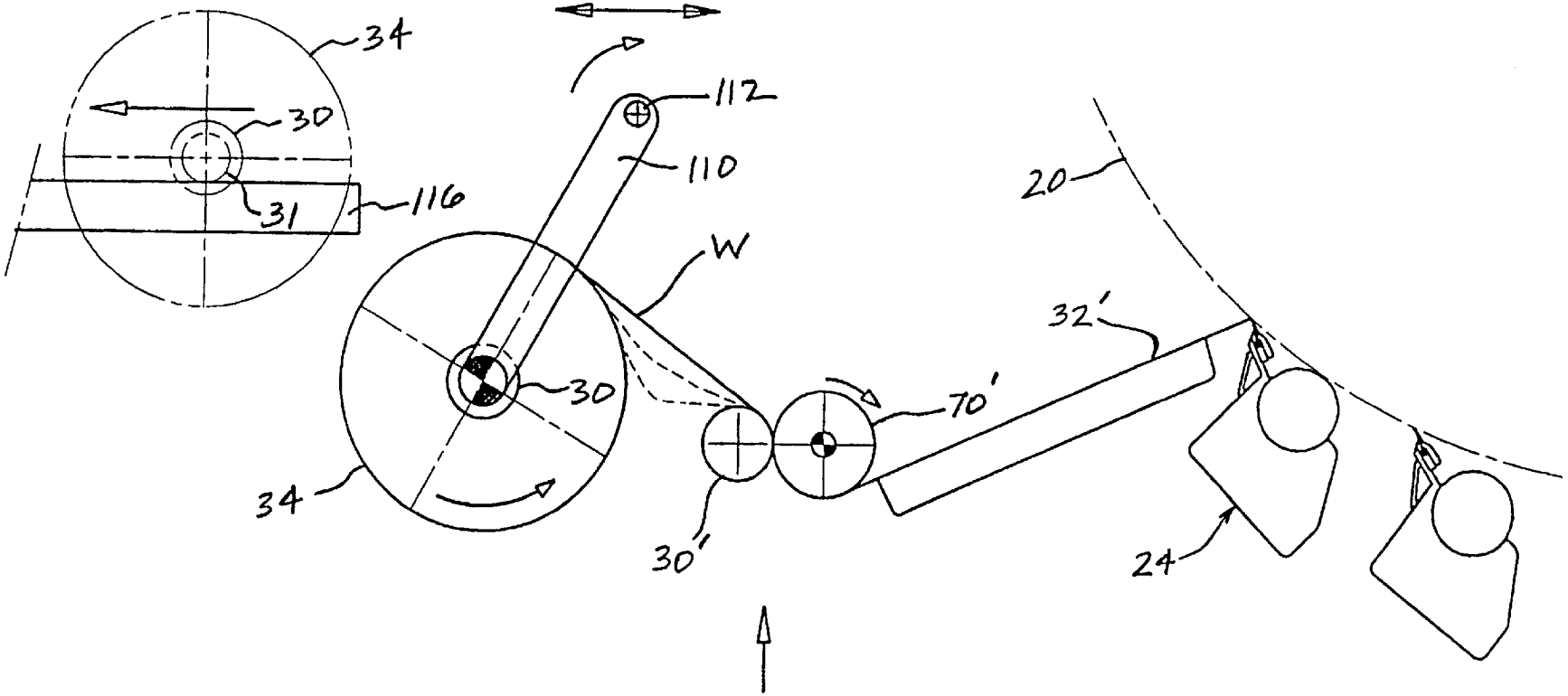
Figure 8C:
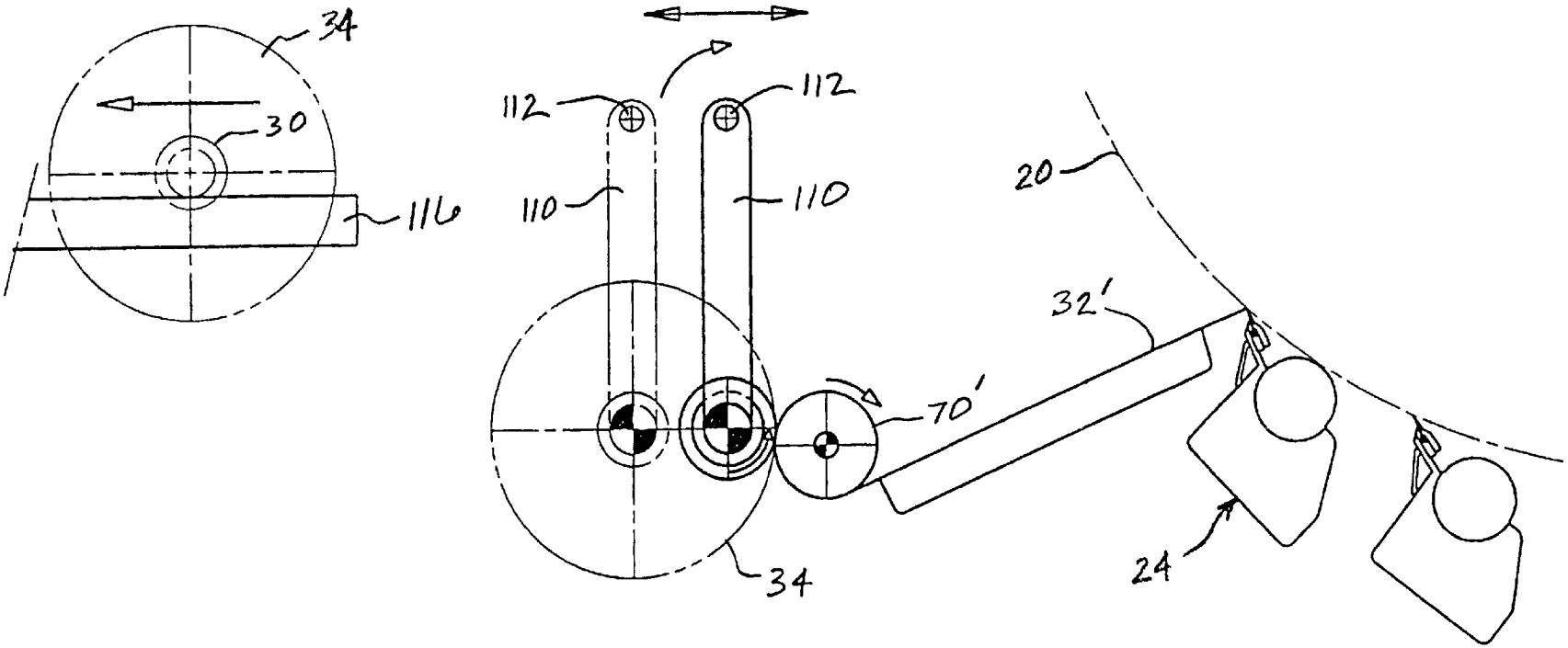

FIGS. 8A through 8C depict a series of sequential views of a winding and changeover operation for another embodiment of the invention having a reel-up in which the reel spool on which the paper roll is wound is supported by a holder pivotally suspended from a pivot arrangement that is horizontally and vertically movable. The illustrated apparatus includes a foil 32' that extends from the creping doctor 24 to a rotatably driven reel drum 70'. The reel drum 70' is supported in a fixed location. The dry end also includes a holder 110 suspended from a pivot arrangement 112 such that the holder 110 is rotatable about the pivot arrangement 112. Lower portions of the holder 110 are adapted to hold opposite ends of a reel spool 30. The reel spool 30 preferably but not necessarily is rotatably driven in the holder 110 by a drive unit 111. The pivot arrangement 112 is positioned relative to the reel drum 70' such that the paper roll 34 building on the reel spool 30 held in the holder 110 forms a nip with the reel drum 70'. The pivot arrangement 112 is movable relative to the axis of the reel drum 70' for controlling nip load in the nip.

The rotation axes of the reel spool 30 and reel drum 70' advantageously are in a common plane P that is generally horizontal but need not be precisely so. The pivot axis of the pivot arrangement 112 and the axis of the reel spool 30 lie in a generally vertical plane during winding, as illustrated in FIG. 8A. Nip load between the paper roll and the reel drum can be controlled in several different ways. As one example, the pivot arrangement 112 can be in a fixed location during winding, in which case nip load will increase in a set fashion as the diameter of the paper roll increases. As another example, nip load can be controlled by controlling the position of the pivot arrangement 112 along a generally horizontal direction, in which case the nip load can be varied in any desired fashion by correlating the position of the pivot arrangement with the weight and/or diameter of the paper roll. Yet another alternative for controlling nip load is to control the rotational position of the holder 110 about the pivot arrangement by a suitable actuator, such as the actuator 114 shown in FIG. 8A or any other device for applying a moment about the pivot arrangement. The force provided by the actuator can be used to give a constant linear nip load or can be such as to correlate the nip load with a parameter such as paper roll diameter, winding speed, paper grade, crepe condition, or other desired parameter. It will also be recognized that nip load can be controlled by a combination of controlling horizontal position of the pivot arrangement 112 and applying a force by the actuator 114 or other actuator.

Once the paper roll has reached a fully wound state, a changeover operation is conducted as illustrated in FIGS. 8A–C. In FIG. 8A, the paper roll 34 building on the reel spool 30 held in the holder 110 has reached a fully wound condition, and hence a new empty reel spool 30' (identical in construction to the reel spool 30 but designated 30' to distinguish it from the full reel spool 30) is moved toward the reel drum 70' in preparation for the changeover. As the empty reel spool 30' approaches the reel drum 70', the holder 110 for the reel spool 30 is rotated about the pivot arrangement 112 by suitable actuators 114 to carry the paper roll 34 away from the reel drum 70' as shown in FIG. 8B. Although the actuator 114 is not shown in FIGS. 8B–D, it will be understood that the actuator 114 or its equivalent would be present in these embodiments for facilitating the changeover operation and/or for controlling nip load as noted above. The pivot arrangement 112 can also be horizontally and/or vertically translated to assist in moving the paper roll away from the reel drum, if desired. A free draw is thereby created between the reel drum 70' and the paper roll 34 over which the web W extends. The empty reel spool 30' is brought into engagement with the reel drum 70'. As the full reel spool 30 is moved away from the reel drum 70', the rotational speed of the reel spool 30 is reduced so that slack is created in the web W as indicated in broken lines in FIG. 8B. When sufficient slack exists in the web, the web is severed by a suitable apparatus (not shown) and the leading end of the web is caused to wrap around and adhere to the empty reel spool 30'. Various techniques are known in the art for assisting in making the leading end of the web wrap around the reel spool so that the web will begin to be wound thereonto.

The fully wound paper roll 34 is next carried by the holder 110 to a set of rails 116 configured to support opposite ends of the reel spool 30. The holder 110 can be rotated about the pivot arrangement 112 and/or the holder 110 and its pivot arrangement 112 can be translated as a unit to facilitate positioning the opposite ends 31 of the reel spool 30 above the rails, and then the opposite ends 31 of the reel spool are set onto the rails 116. The reel spool 30 is then released from the holder 110. The paper roll 34 is now free to be moved along the rails 116 to a further processing station. The holder 110 is then moved back to engage the new reel spool 30' and the drive unit 111 is connected to the reel spool shaft so as to drive the reel spool for winding paper onto the spool. As the paper roll 34 builds on the reel spool 30', the holder 110 can be moved continuously away from the reel drum, as shown in broken lines in FIG. 8C, to compensate for the increasing diameter of the paper roll. This is preferably accomplished by a horizontal movement of the pivot arrangement 112.

Figure 8D:
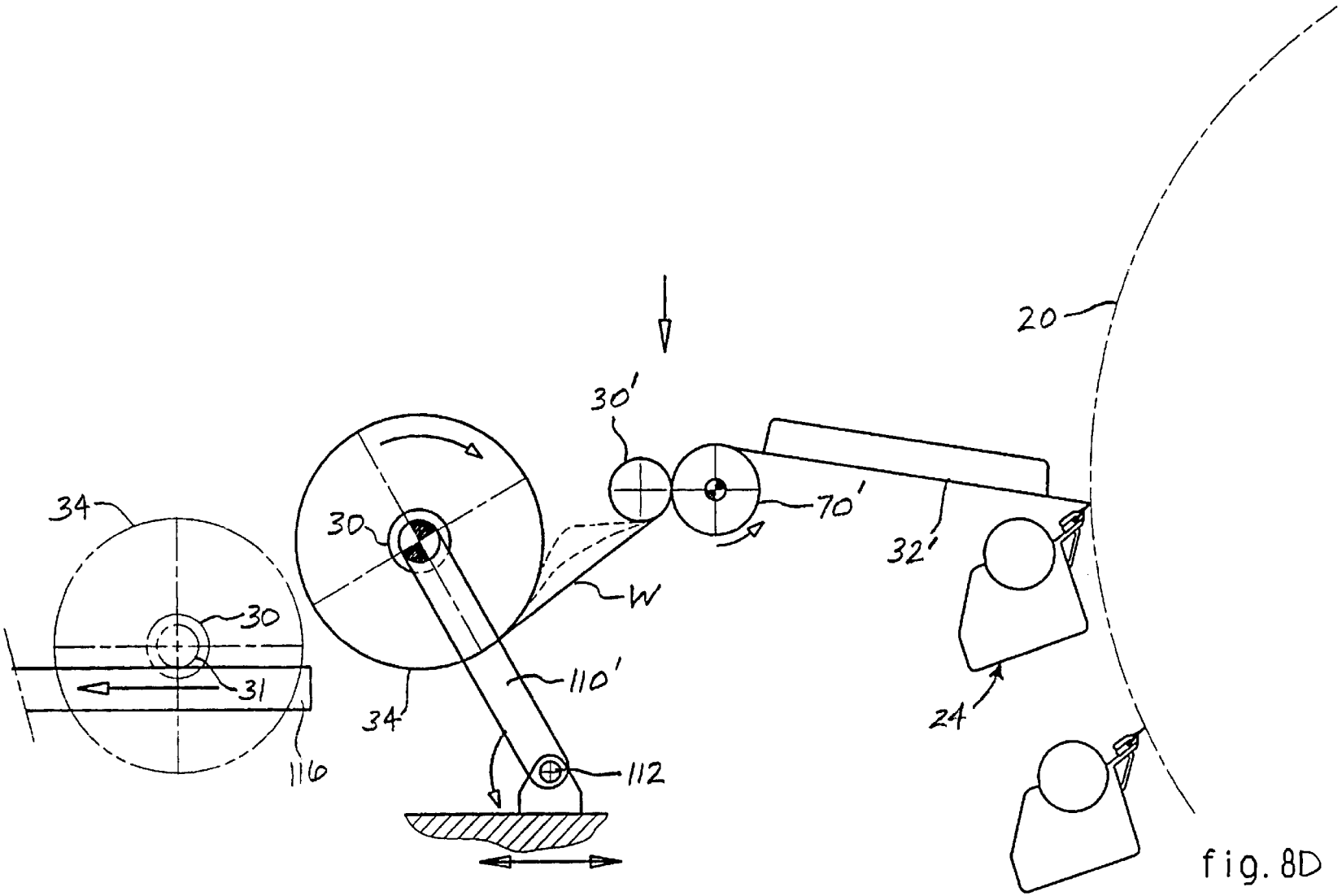
FIGS. 8D and 8E are sequential views similar to FIGS. 8B and 8C, showing an alternative embodiment of the invention.
Figure 8E:
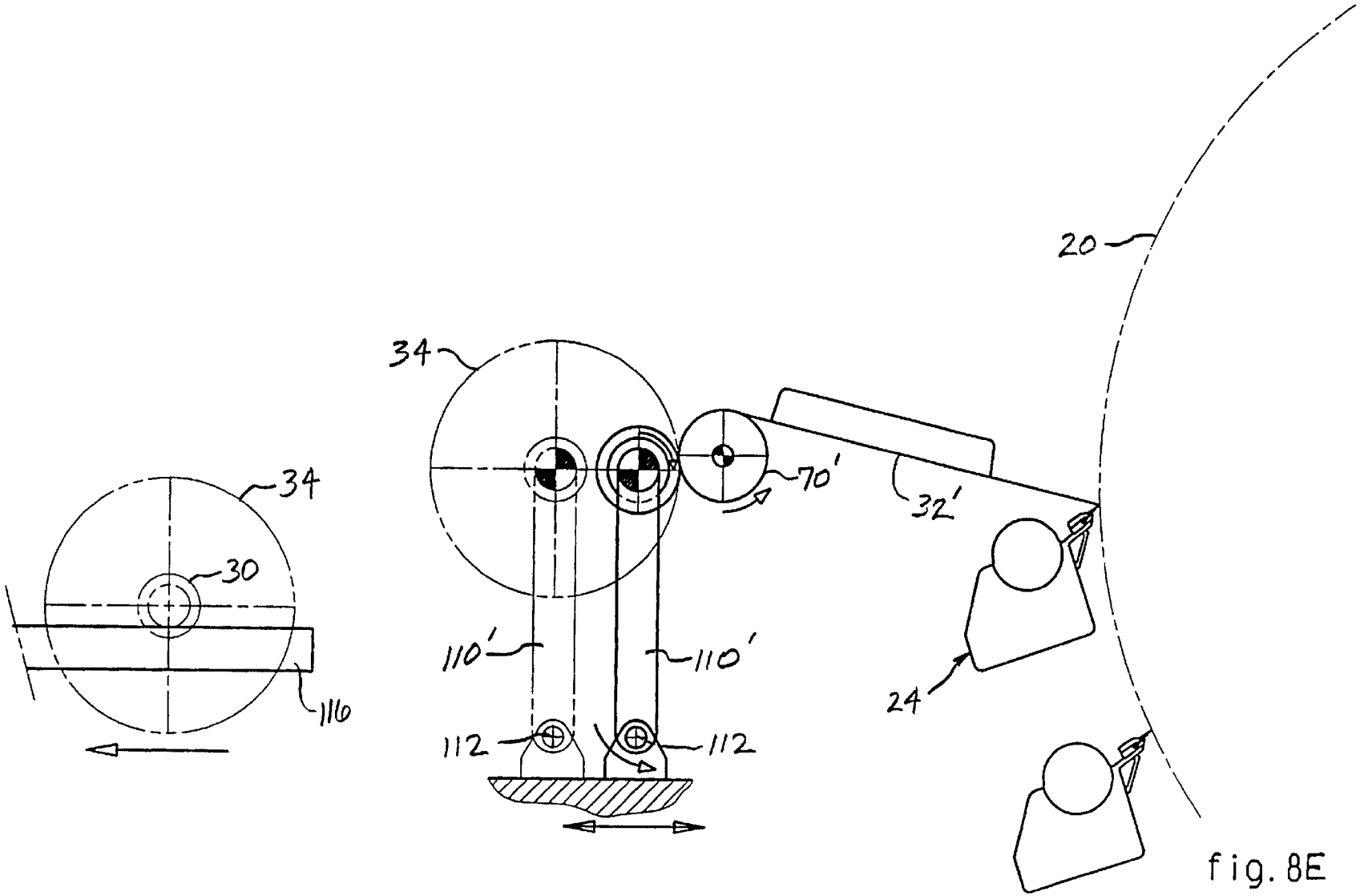

FIGS. 8D and 8E show sequential views similar to FIGS. 8B and 8C, but for an alternative embodiment in which the holder 110' is disposed generally below the paper roll 34 rather than above it. In principle, however, the apparatus functions in the same manner as described above in connection with FIGS. 8B and 8C.

Figure 10A:
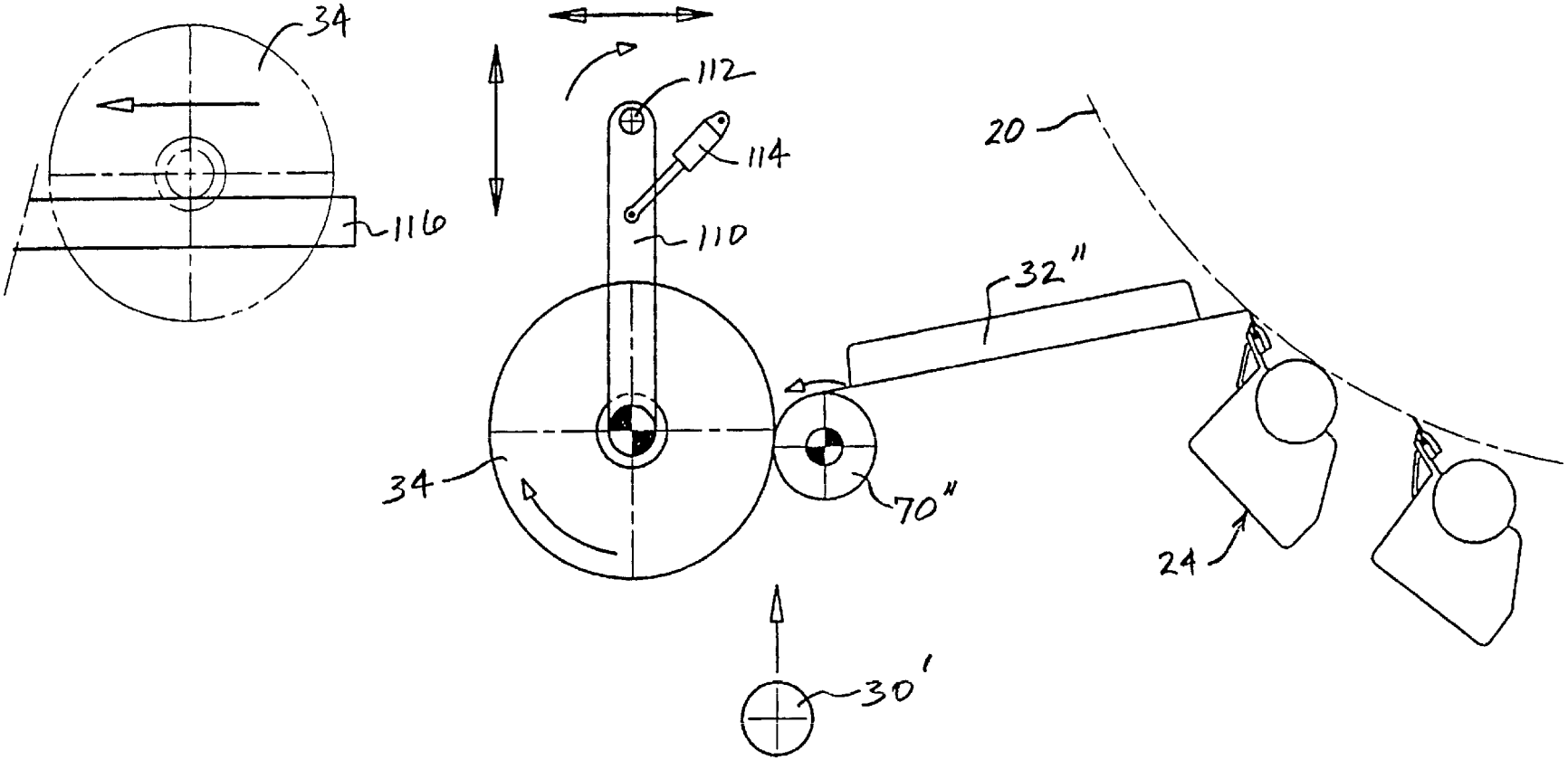
FIGS. 10A through 10C are sequential views similar to FIGS. 8A–C and 9A–B, showing a winding and changeover operation for still another embodiment of the invention having a reel-up similar to that of FIG. 1.
Figure 10B:
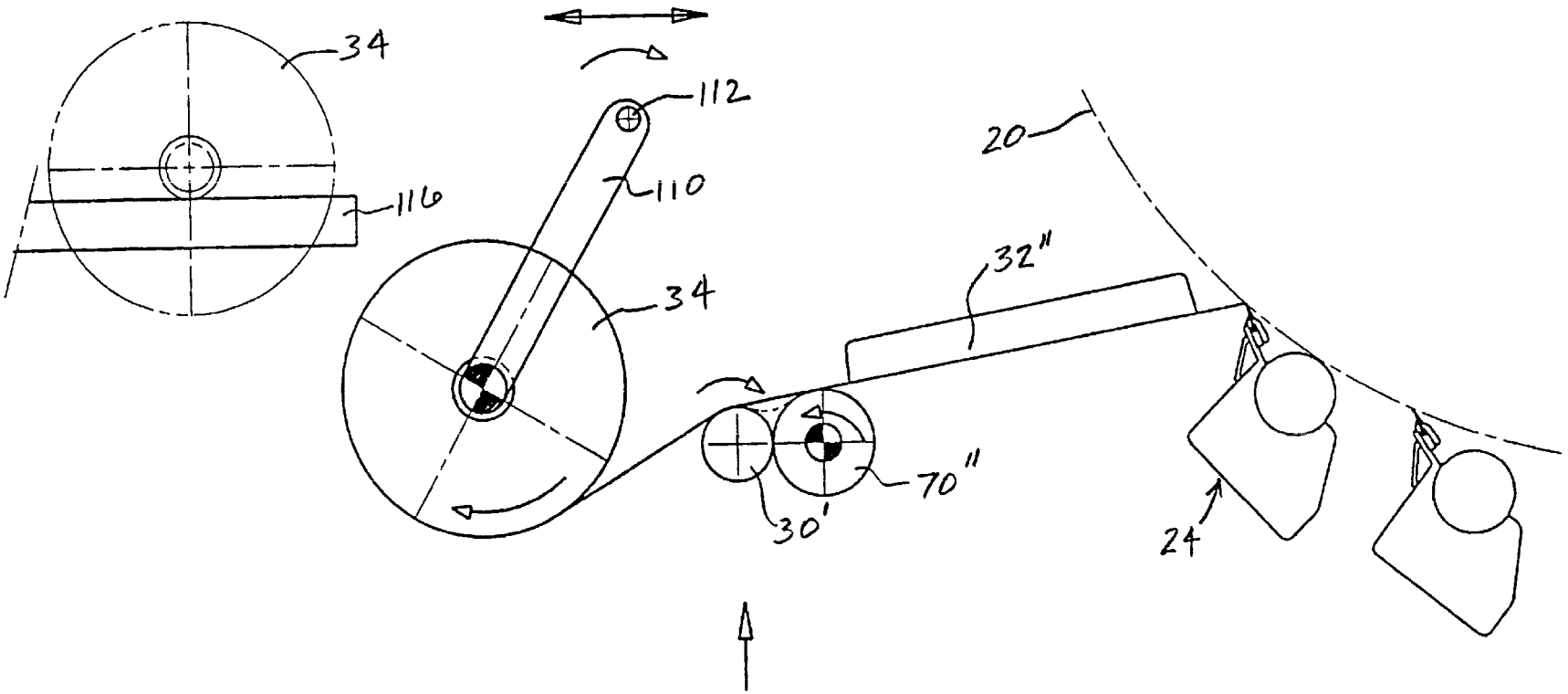
Figure 10C:
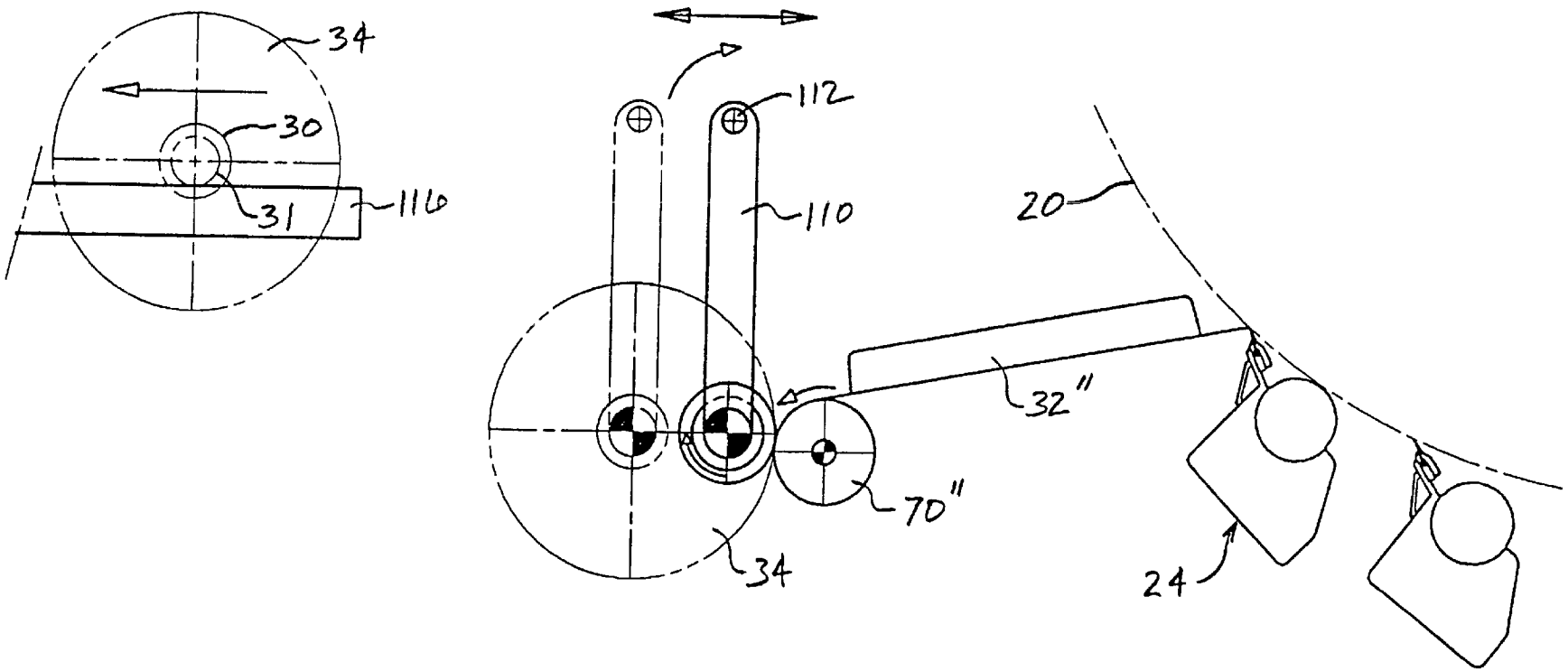

FIGS. 10A through 10C illustrate another embodiment of a reel-up and changeover operation generally similar to that of FIGS. 8A–C, except that the web travels along the lower side of the foil 32" rather than the upper side, and the downstream edge of the foil engages the reel drum 70" on its upper side rather than its lower side, and accordingly the directions of rotation of the reel drum 70" and the reel spool 30 are reversed from those in FIGS. 8A–C. In other respects, the reel-up operates similarly to that of FIGS. 8A–C and the changeover operation is carried out in a similar way.

Figure 9A:
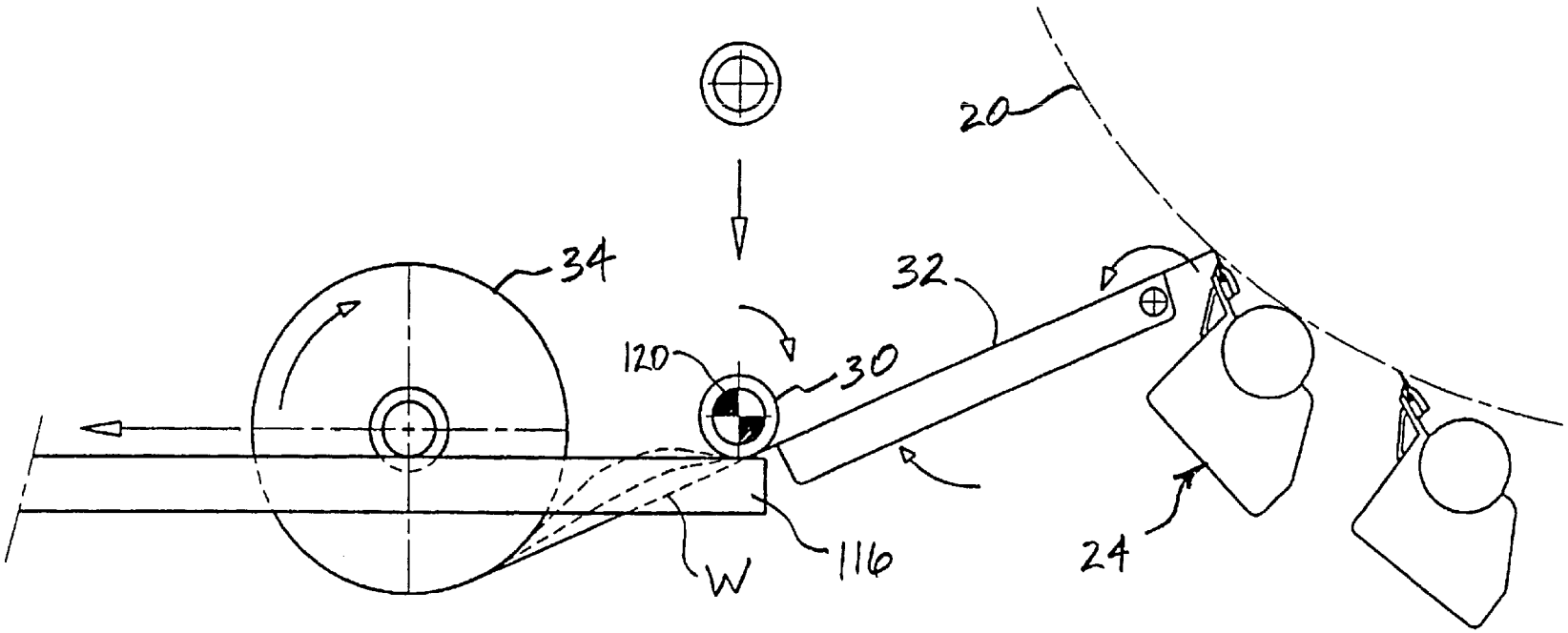
FIGS. 9A and 9B are sequential views of a reel-up and changeover operation in accordance with a further embodiment of the invention similar to the embodiment of FIG. 1.
Figure 9B:
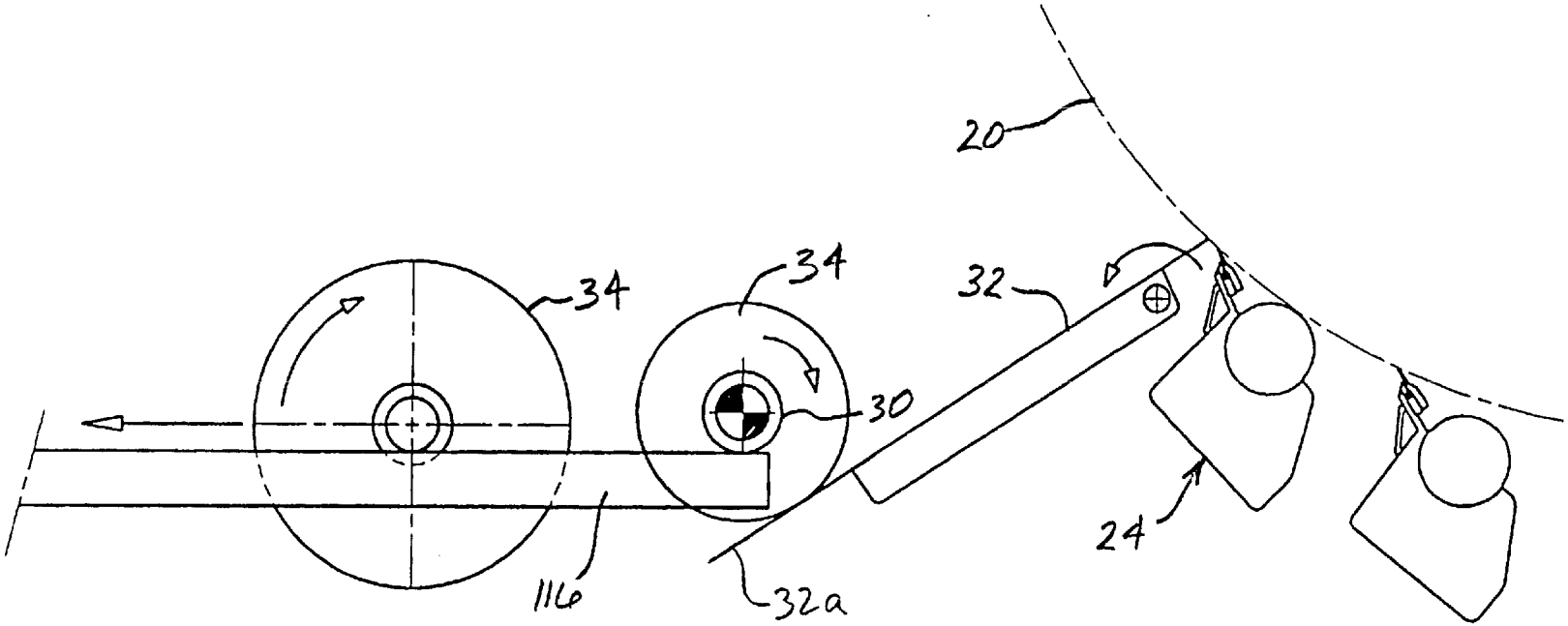

FIGS. 9A and 9B depict an alternative embodiment of a reel-up and changeover operation in accordance with the invention. The reel-up includes a driven reel spool 30 and a pivotable foil 32 whose downstream edge 32*a* forms a nip with the paper roll 34. The edge 32*a* can be a flexible edge as previously described, if desired. An empty reel spool 30 is shown in FIG. 9A in a winding position engaged by a suitable drive unit 120. The reel spool in the winding position is disposed on or just above a set of rails 116 for supporting a previously wound paper roll 34 as described above in connection with FIGS. 8A–C. FIG. 9A depicts the situation at the moment when the empty reel spool 30 has just been lowered into the winding position above the rails. The previously wound paper roll 34 has been moved along the rails 116 away from the winding position. The rotation of the paper roll 34 is slowed so as to create slack in the web W as indicated in broken lines in FIG. 9A. When sufficient slack exists in the web, the web is severed and the leading end of the web is caused to turn up and begin winding onto the empty reel spool 30 in the winding position.

FIG. 9B shows the reel-up at a later time during the winding process when the building paper roll is about half full. The foil 32 is continuously rotated downwardly to keep the downstream edge of the foil in nipping engagement with the paper roll as it builds in diameter. As discussed above in connection with FIG. 1, the rotational positioning of the foil 32 is controlled so as to control the nip load.

Figure 9C:
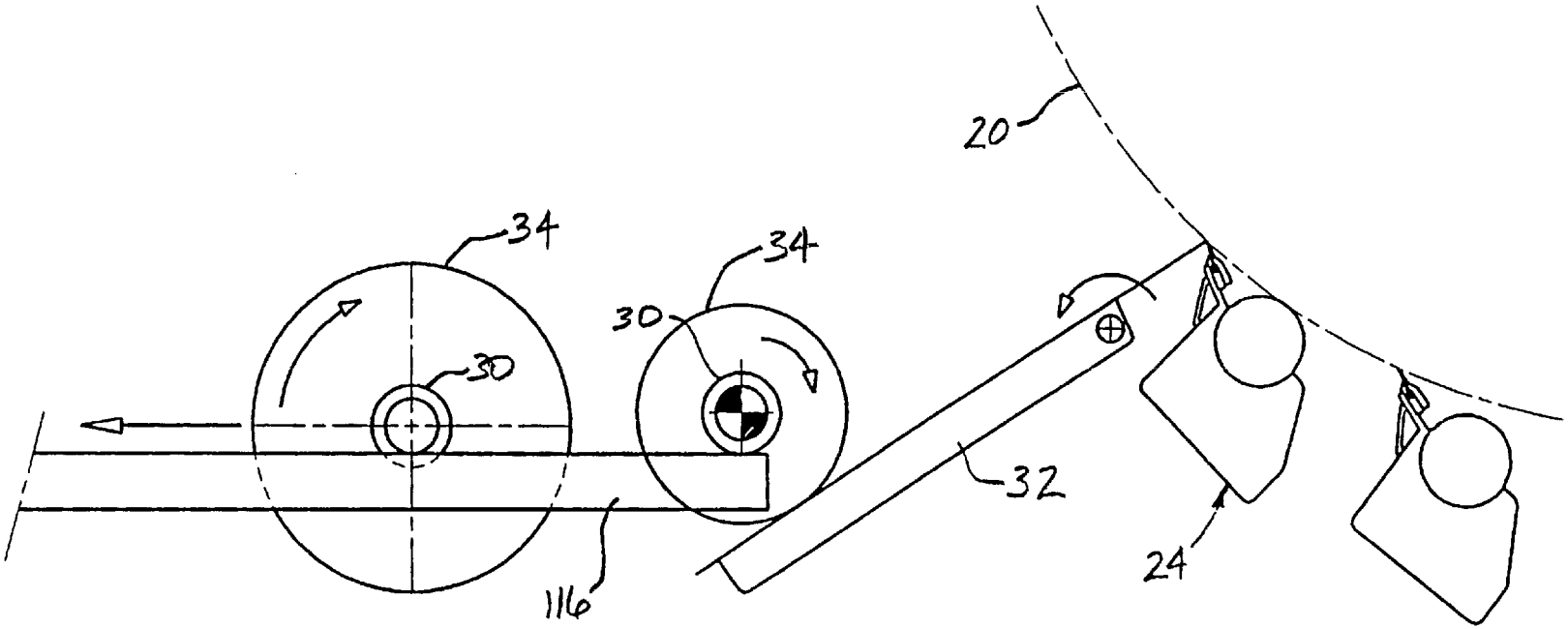
FIG. 9C is a view similar to FIG. 9B, showing an embodiment in which the foil forms a nip with the paper roll.

FIG. 9C is a view similar to FIG. 9B, but showing an alternative embodiment in which a non-flexible part of the foil 32 forms a nip with the paper roll 34. Of course, it is also possible to employ an arrangement similar to those of FIGS. 9A–C, but in which the foil does not form a nip with the paper roll. For instance, a very short free draw can exist between the downstream edge of the foil and the paper roll.

Figure 11A:
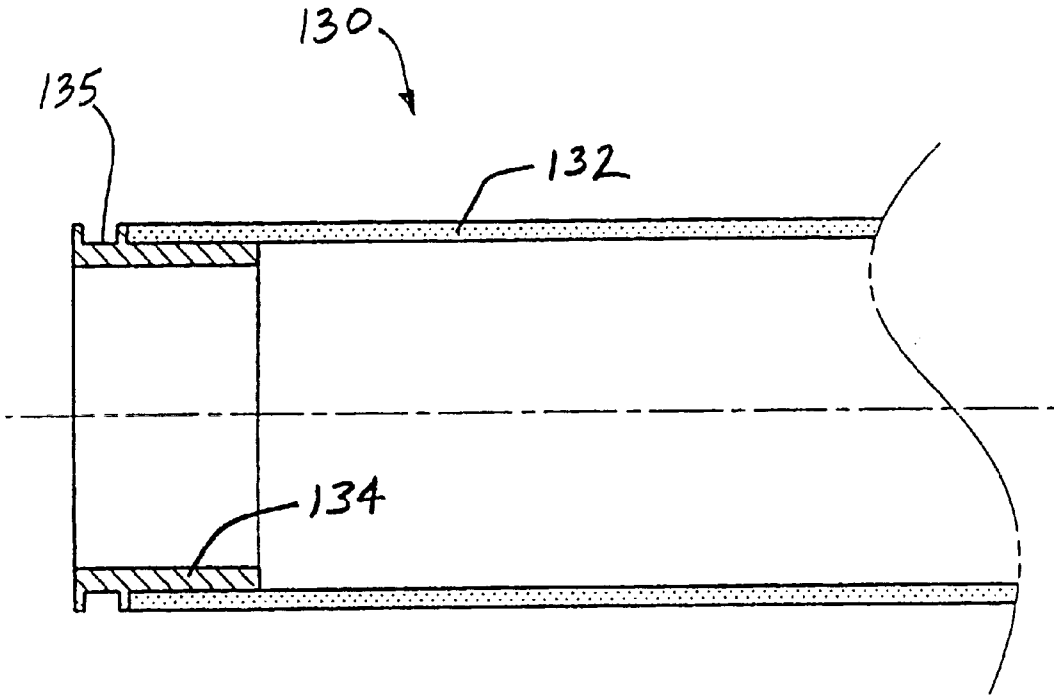
FIG. 11A depicts a fiber-matrix composite shaftless core in accordance with one embodiment of the invention.
Figure 11B:
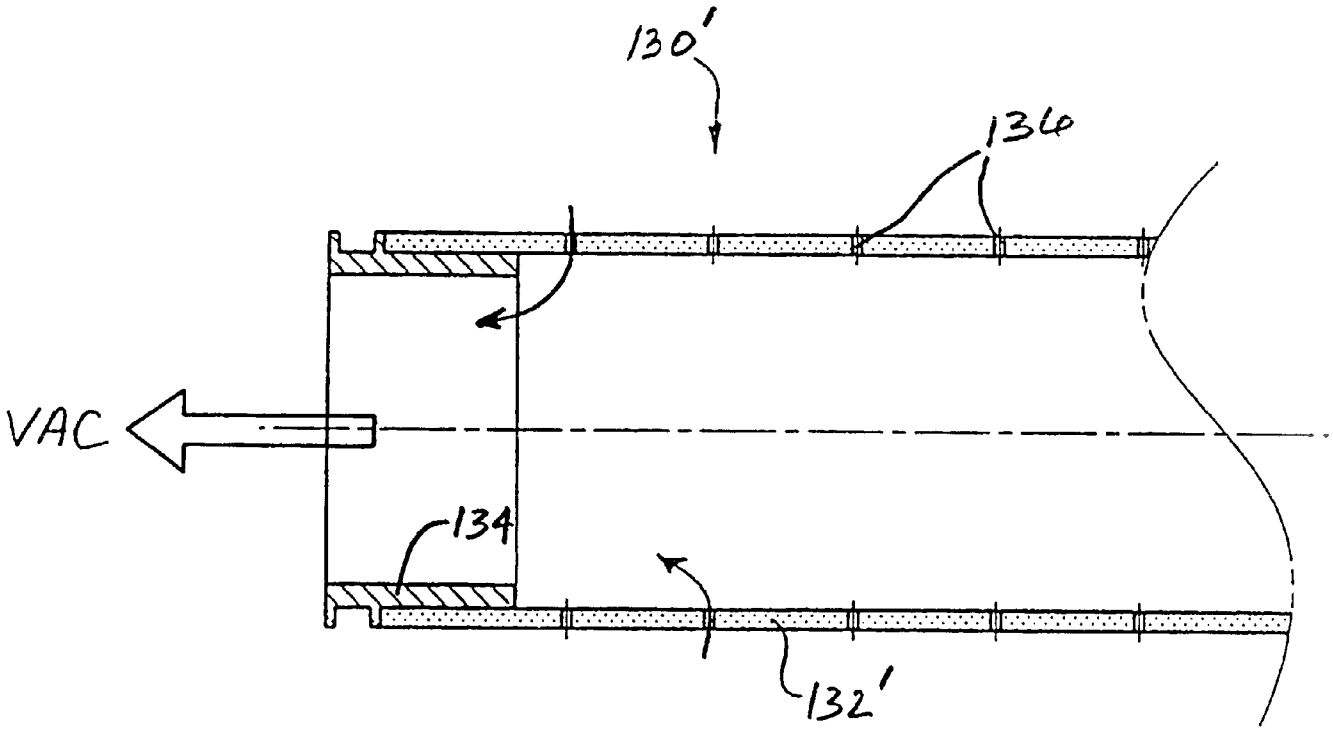
FIG. 11B shows a composite shaftless core in accordance with another embodiment of the invention.
Figure 11C:
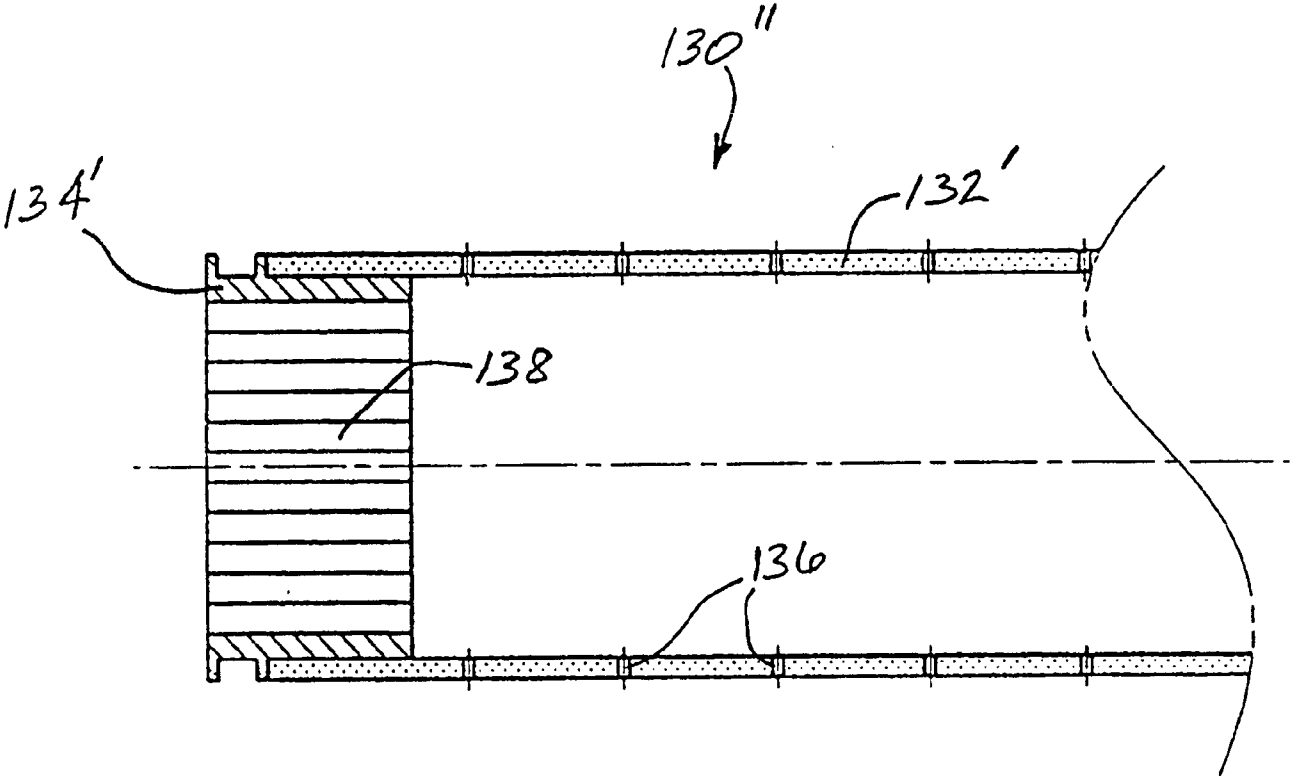
FIG. 11C shows a composite shaftless core in accordance with a still further embodiment of the invention.

FIGS. 11A through 11C depict various embodiments of a composite shaftless core in accordance with the invention. The composite shaftless core 130 shown in FIG. 11A comprises a fiber-matrix composite spool portion 132 of generally hollow cylindrical form, and a metal bushing or end fitting 134 at each end of the spool portion 132. The spool portion 132 defines the surface onto which a paper web will be wound during a reeling operation. The spool portion 132 can be formed of various fiber-matrix composite materials, including those based on fibers of carbon, aramid, glass, and others known in the art. The metal end fittings 134 can be glued or otherwise attached to the spool portion 132. The metal end fittings serve as points of connection to other components such as chuck systems, rails, and the like. The fittings can include an annular groove 135 for mating with a rail or other component. Although the structure of the end fittings could be produced in fiber-matrix composite material integral with the spool portion 132, it is preferable to use the metal end fittings 134 because they provide better resistance to wear than composite material. The composite shaftless core 130 is used in place of conventional reel spools formed entirely of metal that are used with or without paper cores sleeved over them. The composite shaftless core 130 is substantially lighter in weight than a conventional metal reel shaft or metal shaft and paper core combination. Furthermore, the composite shaftless core can be used directly in rewinding and converting operations. The composite shaftless core can also be made with a high degree of precision so that it has a center of gravity substantially at the rotation axis about which it rotates. Accordingly, the composite shaftless core can substantially reduce vibrations relative to a conventional steel shaft with paperboard core. The high degree of dimensional control made possible by the composite shaftless core also means that the centering of the core can be highly accurate, and hence the nip load can be accurately controlled because the eccentricity of the building paper roll can be kept very small.

FIG. 11B depicts an embodiment of a composite shaftless core 130' in which the fiber-matrix composite spool portion 132' has a plurality of holes 136 formed through its side wall. Vacuum is exerted through the end of the composite shaftless core 130' at selected times during a processing operation to cause air to be drawn inwardly through the holes 136 into the interior of the shaft. For example, vacuum can be used during a changeover operation in a reel-up to assist in starting the web onto the composite shaftless core 130'. The composite shaftless cores 130 and 130' can be used in any of the above-described embodiments of the invention.

FIG. 11C shows yet another embodiment of a composite shaftless core 130" suitable for use as a center-driven shaft, having a perforated spool portion 132' as in the previously described embodiment, and including metal end fittings 134' that have teeth or splines 138 formed along their inwardly facing surfaces for engaging a toothed or splined drive unit. The composite shaftless core 130" can be used in any of the above-described embodiments of the invention requiring a driven reel spool.

When the perforated composite shaftless core 130', 130" is used in a reel-up, the connection of vacuum to the interior of the shaft can be timed relative to the severing and turn-up of the web so that the severed web is suctioned onto the shaft as the shaft is rotated, thus facilitating the winding operation.

Many modifications and other embodiments of the invention will come to mind to one skilled in the art to which this invention pertains having the benefit of the teachings presented in the foregoing descriptions and the associated drawings. For example, the embodiments illustrated and described herein as having a Yankee dryer could instead have other types of drying devices such as through-air dryers. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dry end of a papermaking machine, the dry end comprising:

a Yankee dryer for drying a paper web;

a rotatably driven reel spool for winding the paper web creped from the Yankee dryer thereon, the reel spool being located downstream of and proximate to the dryer; and a winding support belt stretched between at least a pair of spaced-apart guide rolls and supporting the reel spool and a paper roll wound thereon, the belt forming a nip with the paper roll.

2. The dry end of claim 1, further comprising:

a stabilizing foil for supporting and stabilizing the paper web exiting from the dryer, the foil having an upstream end adjacent the dryer and a downstream end proximate the nip such that the paper web is stabilized by the foil between the dryer and the nip.

3. The dry end of claim 2, wherein the dryer comprises a rotating dryer roll and the reel spool rotates in the same direction as the dryer roll, the foil guiding the paper web from the downstream end of the foil onto the paper roll generally at an upper side of the paper roll.

4. The dry end of claim 2, wherein the dryer comprises a rotating dryer roll and the reel spool rotates in an opposite direction from the dryer roll, the foil guiding the paper web from the downstream end of the foil onto the paper roll generally at a lower side of the paper roll.

5. An apparatus for a dry end of a papermaking machine having a Yankee dryer for drying a paper web, the apparatus comprising:

a rotatably driven reel spool for winding the paper web creped from the Yankee dryer; and a belt running in a loop about a plurality of guide rolls, a first of the guide rolls being positioned proximate the dryer and spaced upstream of a growing paper roll wound on the reel spool, a second of the guide rolls being positioned adjacent the paper roll and downstream thereof such that a portion of the loop of the belt between the first and second guide rolls extends from a location proximate the dryer to the paper roll, said portion of the loop stabilizing the paper web as the paper web travels from the dryer to, and is wound on, the paper roll.

6. The apparatus of claim 5, further comprising a device for creating an underpressure disposed within the loop of the belt, and wherein the belt is permeable.

7. A paper machine, comprising:

a forming section for forming a wet paper web;

a drying section for drying the wet paper web, the drying section including at least one through-air dryer (TAD) comprising a foraminous dryer roll and a TAD fabric arranged in an endless loop about guide rolls such that the TAD fabric passes about the dryer roll, the TAD fabric being arranged to receive the wet paper web and carry the web about the dryer roll; and a reel-up located after the through-air dryer for winding the paper web onto a rotating reel spool, the TAD fabric downstream of the dryer roll forming a nip with the reel spool such that the paper web carried by the TAD fabric passes through the nip and winds onto the reel spool to form a paper roll.

8. The paper machine of claim 7, wherein the forming section includes a wire on which the paper web is carried to a web transfer point at which the paper web is transferred from the wire onto the TAD fabric.

* * * * *